US009290872B2

(12) United States Patent
Ishikawa

(10) Patent No.: US 9,290,872 B2
(45) Date of Patent: Mar. 22, 2016

(54) GAS CARRYING THREADING DEVICE OF SEWING MACHINE

(75) Inventor: Masato Ishikawa, Yamagata (JP)

(73) Assignee: SUZUKI MANUFACTURING, LTD., Yamagata (JP)

( * ) Notice: Subject to any disclaimer, the term of this patent is extended or adjusted under 35 U.S.C. 154(b) by 70 days.

(21) Appl. No.: 14/237,400

(22) PCT Filed: Nov. 10, 2011

(86) PCT No.: PCT/JP2011/075976

§ 371 (c)(1),
(2), (4) Date: Feb. 6, 2014

(87) PCT Pub. No.: WO2013/042277

PCT Pub. Date: Mar. 28, 2013

(65) Prior Publication Data

US 2014/0190383 A1 Jul. 10, 2014

(30) Foreign Application Priority Data

Sep. 20, 2011 (JP) ..... 2011-204753

(51) Int. Cl.

| | |
|---|---|
| ***D05B 87/00*** | (2006.01) |
| ***D05B 63/00*** | (2006.01) |
| ***D05B 57/00*** | (2006.01) |
| ***D05B 69/12*** | (2006.01) |

(52) U.S. Cl.

CPC ..... *D05B 87/00* (2013.01); *D05B 57/00* (2013.01); *D05B 63/00* (2013.01); *D05B 69/125* (2013.01); *D05D 2207/04* (2013.01)

(58) Field of Classification Search

CPC ..... D05B 57/00; D05B 63/00; D05B 87/00; D05B 87/045; D05B 69/125; D05B 2207/04

USPC ..... 112/302, 199

See application file for complete search history.

(56) References Cited

U.S. PATENT DOCUMENTS

| | | | | |
|---|---|---|---|---|
| 4,198,915 | A * | 4/1980 | Peterson et al. | 112/225 |
| 5,327,841 | A * | 7/1994 | Sakuma | 112/162 |
| 7,523,712 | B2 * | 4/2009 | Sadasue | 112/302 |
| 7,536,964 | B2 * | 5/2009 | Sadasue | 112/302 |
| 8,857,354 | B2 * | 10/2014 | Sakuma et al. | 112/302 |
| 8,925,472 | B2 * | 1/2015 | Sakuma et al. | 112/302 |
| 2008/0257241 | A1 * | 10/2008 | Sadasue | 112/225 |
| 2012/0210922 | A1 * | 8/2012 | Sakuma et al. | 112/199 |

FOREIGN PATENT DOCUMENTS

| | | |
|---|---|---|
| JP | 2865470 | 3/1999 |
| JP | 2008-119361 | 5/2008 |
| JP | 4741701 | 8/2011 |

OTHER PUBLICATIONS

International Search Report PCT/JP2011/075976 dated Feb. 14, 2012.

* cited by examiner

*Primary Examiner* — Danny Worrell
(74) *Attorney, Agent, or Firm* — Howard & Howard Attorneys PLLC

(57) ABSTRACT

A gas carrying threading device includes a clutch for transmitting power from a sewing machine motor to a drive shaft that drives a stitch forming device at the time of stitch formation or to a gas supply pump at the time of looper threading, a looper threading/stitch forming changeover mechanism for changing over the clutch so that transmission of power to the stitch forming device is interrupted and the power is transmitted to the gas supply pump at the time of the looper threading and the power is transmitted to the stitch forming device and the transmission of the power to the gas supply pump is interrupted at the time of stitch formation, and a changeover prohibition mechanism for prohibiting abnormal changeover to a stitch forming state of the looper threading/stitch forming changeover mechanism during the gas supply operation of the gas supply pump.

7 Claims, 18 Drawing Sheets

GAS CARRYING THREADING DEVICE OF SEWING MACHINE

FIELD OF THE ART

The present invention relates to a gas carrying threading device of sewing machine, particularly relates to the gas carrying threading device of sewing machine such as a serger, a double chain stitch sewing machine, or a interlock stitch sewing machine for performing a threading automatically to a looper by utilizing a pressurized gas.

BACKGROUND OF THE ART

Heretofore, in such as the serger, the double chain stitch sewing machine, or the interlock stitch sewing machine, the gas carrying threading device which is connected by a hollow looper thread guide which leads from a thread introduction portion which inserts the looper thread to a looper thread guide outlet of a loop-taker point of the looper and which feeds a looper thread by utilizing a flow of a pressurized gas which is supplied to the hollow looper thread guide is known.

By this gas carrying threading device, a complicated thread guard is unnecessary and a threading that a handleability is easy can be performed. Therefore, there are no mistake of the threading, no protrusion of the thread in mid-process, and no entanglement of the inserted looper thread with other thread, and thereby the threading can be performed at once by the extremely easy operation.

In a structure of such the gas carrying threading, a pathway for the threading becomes considerably simple, and an operation of the threading becomes easy, and an entanglement of the thread or an incidence of a thread breakage can be dissolved.

However, in the structure of such the gas carrying threading, while pressing a stopper shaft (positioning pin) for a stop positioning plate by one hand, a pulley is rotated manually by the other hand, and thereby a stitch forming device must be locked and concurrently a threading connecting device must be connected. Therefore, it is difficult to understand how to use this threading device for the operator who is not familiar with the sewing machine, and an insertion operation of the thread which is performed by using both hands concurrently is considerably complex, thereby the training of that purpose is necessary.

For this reason, the gas carrying threading device of sewing machine which generates the pressurized gas for carrying the looper thread by gas in the gas supply pump which operates by changing over the sewing machine motor which drives a stitch forming device and is able to perform the threading to the looper by one-touch operation is proposed (refer to Patent document No. 1).

PRIOR ART DOCUMENT

Patent Document

[Patent document No. 1] JP-4741701-B2

SUMMARY OF THE INVENTION

Problem to be Solved by the Invention

However, in the structure of this gas carrying threading, in the operation of the gas supply of the gas supply pump, although the structure of this gas carrying threading is equipped with a clutch changeover limit mechanism to avoid the transition of a looper threading/stitch forming changeover mechanism from a looper threading state to a stitch forming state, this clutch changeover limit mechanism utilizes a pneumatic actuator (air damper) which supplies the gas from the gas supply pump. Therefore, first, in composition, because the number of parts increases, there is a problem that the structure is complicated. And second, in quality, there is a problem that it is troublesome to maintain accuracy for planning stabilization of the fit accuracy of the pneumatic actuator and the air leakage quantity of a retarder.

The present invention was conducted to solve these difficult points. The object of the present invention is to provide the gas carrying threading device of sewing machine that the pressurized gas to carry the looper thread by the gas is generated in the gas supply pump which operates by changing over the sewing machine motor which drives the stitch forming device, the threading to the looper is possible by one-touch operation, the looper threading/stitch forming changeover operation is performed by one hand safely and steadily, the structure is simplified and the quality is high.

Means for Solving the Problems

In order to achieve such the object, a gas carrying threading device of sewing machine of the present invention is equipped with at least one looper having a hollow structure from a looper thread inlet to a looper loop-taker point thread outlet, a looper thread introduction mechanism inserting a looper thread which is led to the looper, a hollow looper thread guide extending from the looper thread introduction mechanism to the looper thread inlet and having a looper thread guide outlet, a gas supply pump that a looper threading of the looper thread is performed from the looper thread introduction mechanism to the looper thread guide outlet through the hollow looper thread guide by the gas carrying, a clutch for respectively transmitting power from the sewing machine motor to a drive shaft driving a stitch forming device including the looper at the time of the stitch formation or to the gas supply pump at the time of the looper threading, a looper threading/stitch forming changeover mechanism for changing over the clutch so that the transmission of the power to the stitch forming device is interrupted and the power is transmitted to the gas supply pump at the time of the looper threading and so that the power is transmitted to the stitch forming device and the transmission of the power to the gas supply pump is interrupted at the time of the stitch formation, and a changeover prohibition mechanism for prohibiting an abnormal changeover to a stitch forming state of the looper threading/stitch forming changeover mechanism during a gas supply operation of the gas supply pump.

Besides, in the gas carrying threading device of sewing machine of the present invention, a looper threading/stitch forming changeover manual operating portion of the looper threading/stitch forming changeover mechanism is hidden by a front cover of the sewing machine which can open and close freely, at the time of the looper threading, the front cover is opened and the looper threading/stitch forming changeover manual operating portion is changed over to the looper threading state, at the time of the stitch formation, after the looper threading/stitch forming changeover manual operating portion is changed over to the stitch forming state, the front cover is closed, thus the stitch forming device is operated.

Besides, in the gas carrying threading device of sewing machine of the present invention, the changeover prohibition mechanism is equipped with a front cover opening and closing detection piece which is attached pivotally at a sub-frame, detects the opening and closing of the front cover and is attached pivotally at an axis which is formed at a front face cover, a prohibition active arm which is attached pivotally at a prohibition active arm attaching pedestal which is fixed at the sub-frame by resisting elastic repulsion of a spring and is pivoted depending on a pivot of the front cover opening and closing detection piece, and a prohibition driven arm which is fixed at the looper threading/stitch forming changeover mechanism and prohibits an abnormal changeover to a stitch forming state of the looper threading/stitch forming changeover mechanism depending on a pivot of the prohibition active arm during the opening of the front cover, at the time of the looper threading, the front cover is opened, the front cover opening and closing detection piece releases a press of the prohibition active arm by a release of the press of a pressing end which is formed in an inner surface of the front cover, the prohibition active arm is pivoted by the spring, a tongue piece of the prohibition driven arm is latched together at a tip plane portion of the prohibition active arm, the looper threading/stitch forming changeover manual operating portion is changed over to the looper threading state, the stitch forming device is locked by rotating a pulley manually, simultaneously, a threading connecting device is operated, the prohibition driven arm is latched together at a side surface portion from the tip plane portion of the prohibition active arm, and the abnormal changeover to the stitch forming state of the looper threading/stitch forming changeover mechanism is prohibited, at the time of the stitch formation, after the looper threading/stitch forming changeover manual operating portion is changed over to the stitch forming state, the front cover is closed and the front cover opening and closing detection piece which is pivoted by the press of the pressing end which is formed at an inner surface of the front cover is pivoted, the prohibition active arm is pivoted, the prohibition driven arm is released from the side surface portion of the prohibition active arm onto the tip plane portion, the changeover to the stitch forming state of the looper threading/stitch forming changeover mechanism is activated, and the stitch forming device is operated.

Besides, in the gas carrying threading device of sewing machine of the present invention, the clutch is equipped with a pin clutch having a clutch slider which is moved to one of a pump drive member which transmits the power to the gas supply pump and a stitch forming drive member which is fixed to one end of the drive shaft and transmits the power to the stitch forming device so that approach/separation becomes free through a clutch changeover spring depending on a manual operation of a looper threading/stitch forming changeover manual operating portion and that the approach/separation state is held and the power from the sewing machine motor is transmitted.

Besides, in the gas carrying threading device of sewing machine of the present invention, the looper thread guide outlet and the looper thread inlet are equipped with a threading connecting device which is disposed so that approach/separation becomes free respectively at the time of the looper threading and at the time of the stitch formation depending on the manual operation of the looper threading/stitch forming changeover manual operating portion.

Besides, in the gas carrying threading device of sewing machine of the present invention, by rotating a pulley which is fixed at one end of the drive shaft manually, when the looper thread guide outlet and the looper thread inlet are aligned horizontally, a positioning device which connects the looper thread guide outlet of the hollow looper thread guide and the looper thread inlet of the looper is equipped.

Besides, in the gas carrying threading device of sewing machine of the present invention, in the looper threading/stitch forming changeover mechanism, at the time of the looper threading, the means which changes over the clutch so that the power is transmitted to the gas supply pump and the means which prepares the positioning of the positioning device which connects the looper thread guide outlet of the hollow looper thread guide and the looper thread inlet of the looper, prepares the connection of the threading connecting device which is disposed so that approach/separation becomes free respectively at the time of the looper threading and at the time of the stitch formation, operates the positioning device and interrupts the transmission of the power to the stitch forming device by rotating manually the pulley which is fixed at one end of said drive shaft, and operates the threading connecting device and connects the looper thread guide outlet and the looper thread inlet are included, at the time of the stitch formation, the means which changes over the clutch so that the power is transmitted to the stitch forming device and the means which releases the positioning of the positioning device, and releases the connection of the threading connecting device, and separates the looper thread guide outlet and the looper thread inlet are included.

Besides, in the gas carrying threading device of sewing machine of the present invention, the positioning device has a stop positioning plate, which is coaxially attached at the drive shaft and has a notch at the stop position of the circumferential direction for aligning horizontally the positions of the looper thread guide outlet, a thread take-up lever hole which is formed at a looper take-up lever and the looper thread inlet, and has a positioning pin, which is fitted to the notch by rotating the pulley manually at the time of the looper threading that the looper threading/stitch forming changeover manual operating portion is changed over to the looper threading side and operated manually.

Effect of the Invention

According to the gas carrying threading device of sewing machine of the present invention, it is possible to accomplish the gas carrying threading operation that the pressurized gas to carry the looper thread by the gas is generated in the gas supply pump which operates by changing over the sewing machine motor which drives the stitch forming device, the threading to the looper is possible by one-touch operation, the looper threading/stitch forming changeover operation is performed by one hand safely and steadily, the structure is simplified and the quality is high.

BRIEF DESCRIPTION OF THE DRAWINGS

FIG. 5 (B) An exploded perspective view showing a positioning device which is used in a gas carrying threading device of sewing machine by the present invention.

MODE FOR CARRYING OUT THE INVENTION

Figure 1:
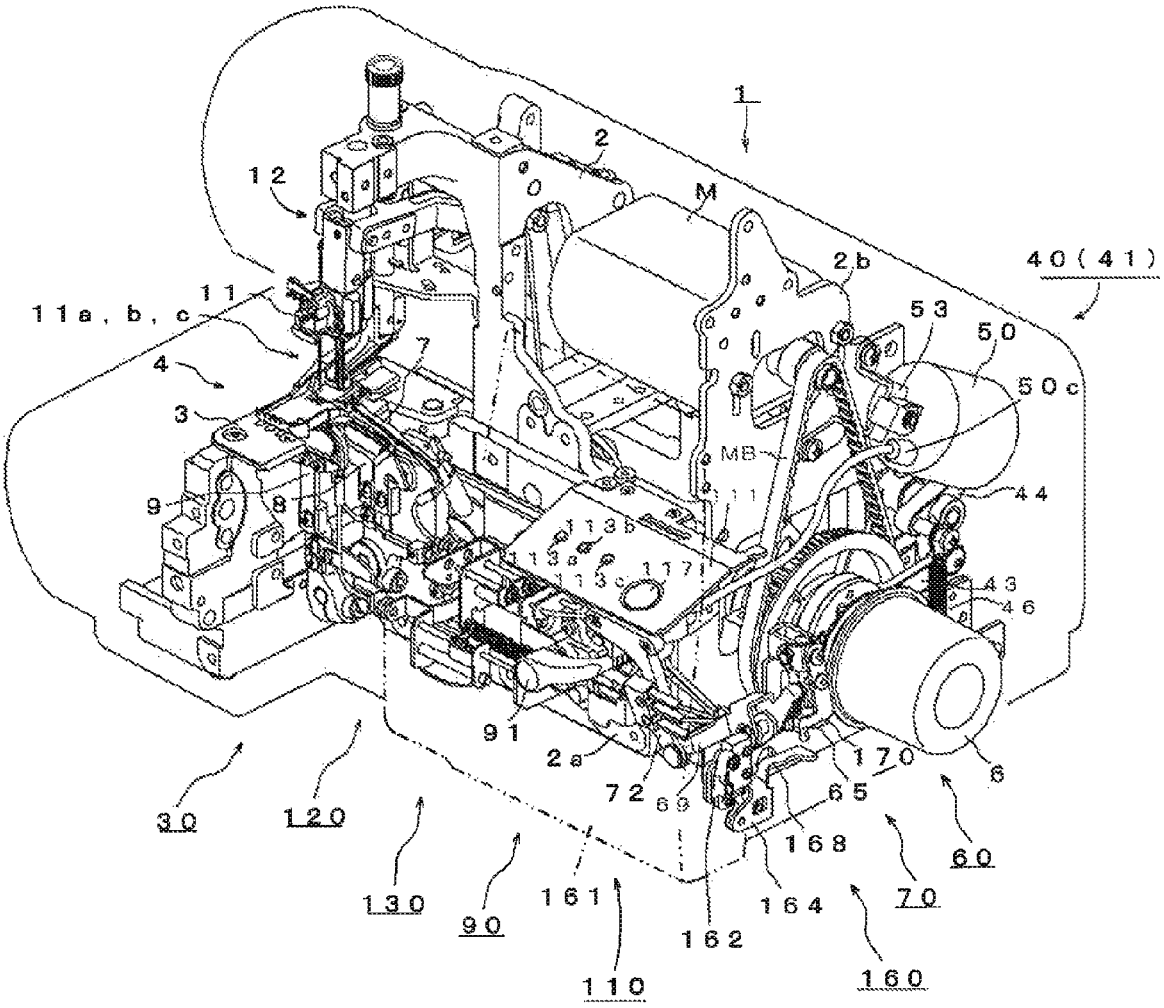
FIG. 1 A perspective view of a three-needle/six-thread serger (double chain stitch sewing machine) applying a gas carrying threading device of sewing machine by the present invention.

Hereinafter, the preferable embodiment that the gas carrying threading device of sewing machine of the present invention is applied to the three-needle/six-thread serger (double chain stitch sewing machine) is explained in detail by referring to the drawings.

Figure 15:
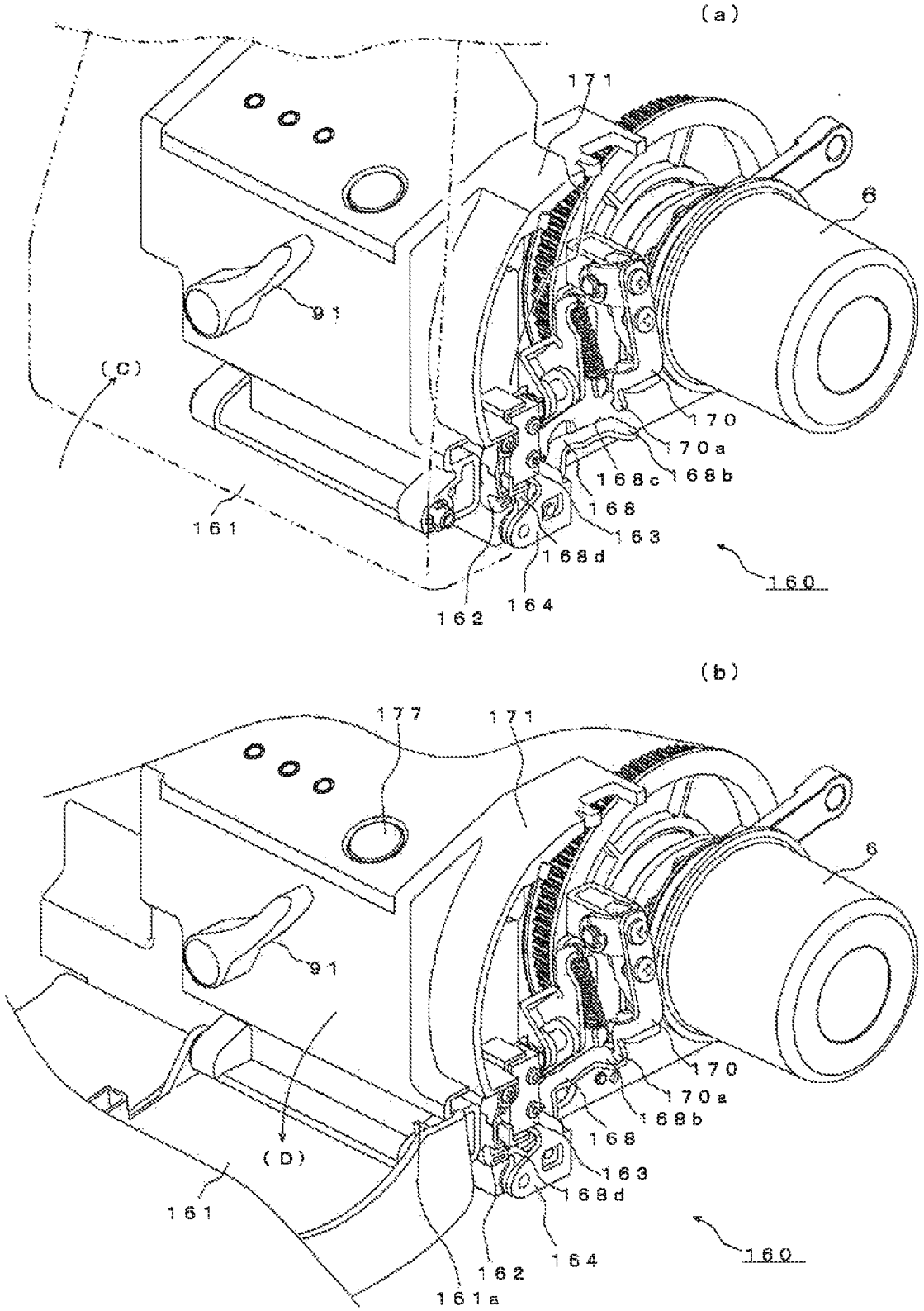
FIGS. 15 (*a*), (*b*) are views showing the relations among the looper threading/stitch forming changeover manual operating portion, the changeover prohibition mechanism and the safety switch in the case that the looper threading/stitch forming changeover manual operating portion is changed over to the stitch forming state in the state that the front cover closes and opens respectively.
Figure 17:
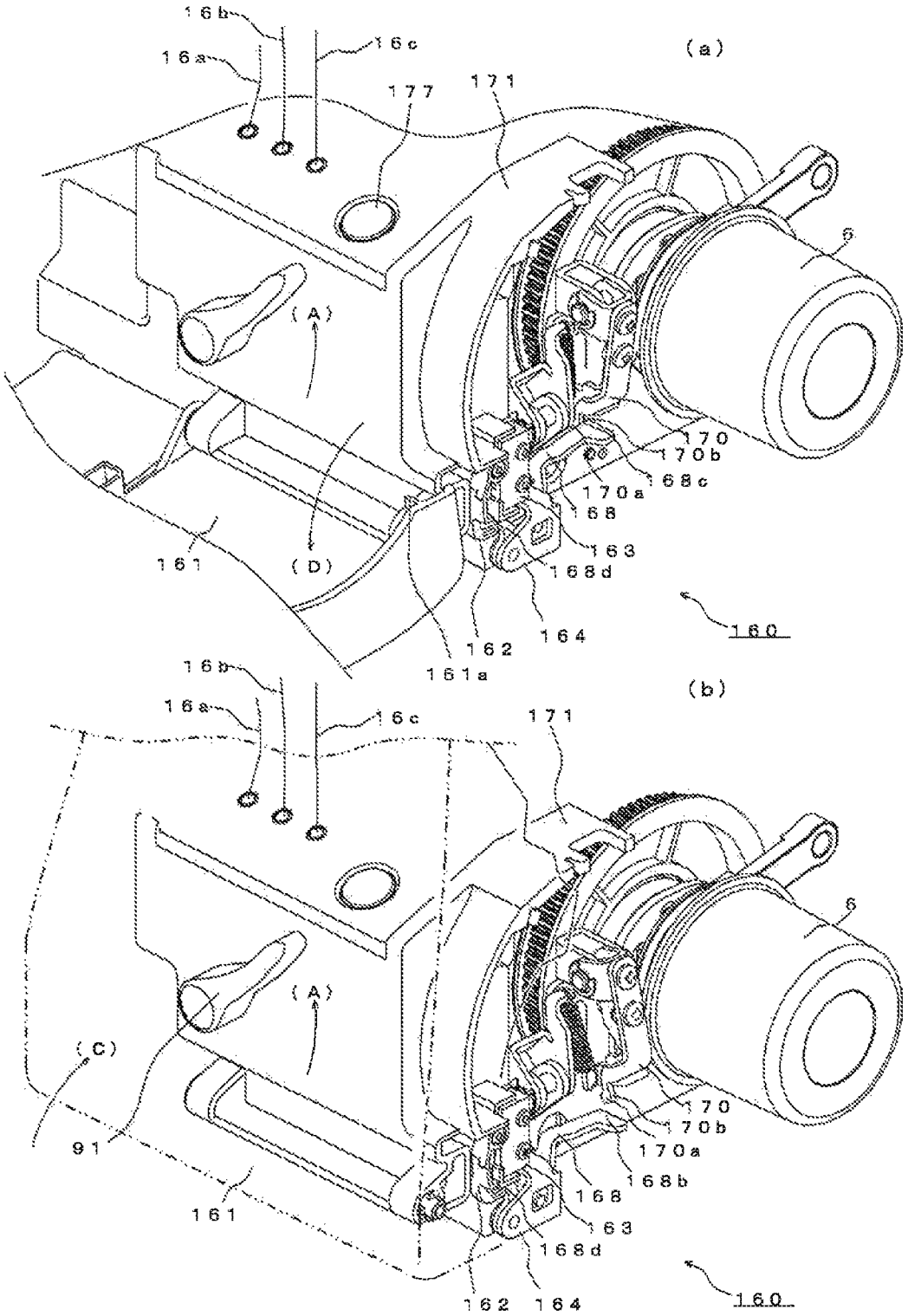
FIGS. 17 (*a*), (*b*) are views showing the relations among the looper threading/stitch forming changeover manual operating portion, the changeover prohibition mechanism and the safety switch in the case that the looper threading/stitch forming changeover manual operating portion is changed over to the stitch forming state in the state that the front cover opens and closes respectively.

As shown in FIG. 1, FIGS. 15 (*a*), (*b*)-FIGS. 17 (*a*), (*b*), the serger 1 is composed from a main frame 2 which forms a bed and an arm. The main frame 2 has sub-frame 2*a*-2*b*. In the serger 1, in that front face, the front cover 161 is attached pivotally so that it can open and close freely at a lower end of the front face cover 171 which is fastened firmly at the main frame 2.

Figure 12:
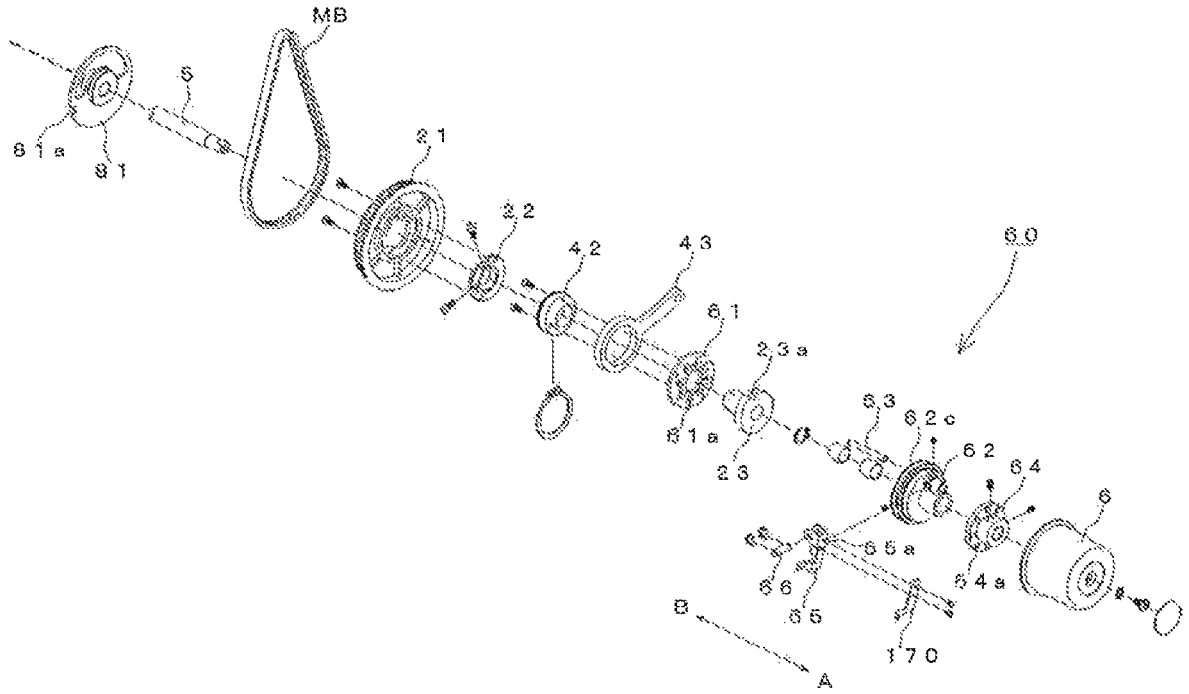
FIG. 12 An exploded perspective view showing a clutch and a positioning device which are used in gas carrying threading device of sewing machine by the present invention.
Figure 13:
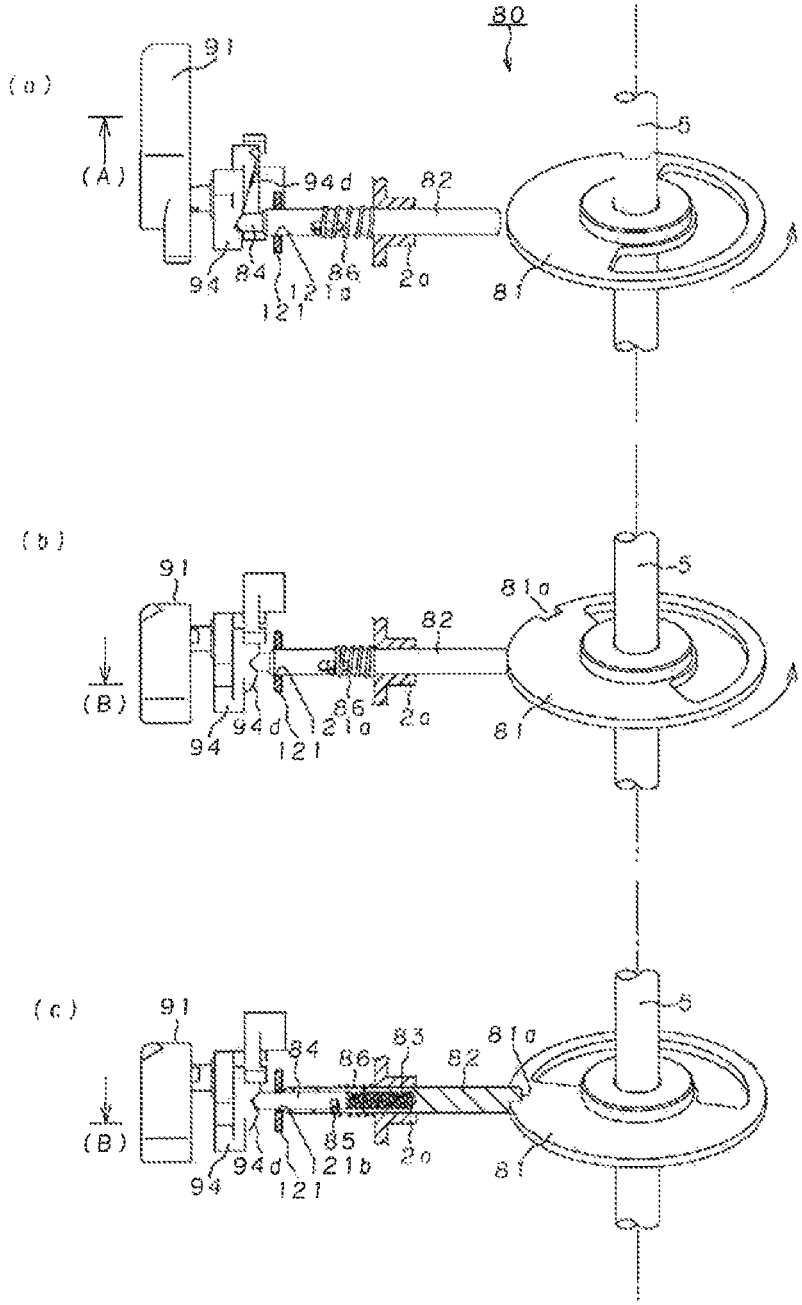
FIGS. 13 (*a*), (*b*) and (*c*) are perspective views showing a looper threading/stitch forming changeover mechanism and a positioning device which are used in gas carrying threading device of sewing machine by the present invention at the time of a stitch formation, at the time of a looper threading preparatory state and at the time of a looper threading respectively.

The sewing machine motor M is attached to the sub-frame 2*b*, and a drive shaft 5 lengthens along the main frame 2 in a horizontal direction (FIG. 2, FIG. 7-FIGS. 9 (*a*), (*b*), FIG. 12-FIGS. 13 (*a*), (*b*), (*c*)). As described below, the drive shaft 5 is rotated and driven through a clutch 60 by using a timing belt MB by the sewing machine motor M (FIGS. 9 (*a*), (*b*)).

Figure 2:
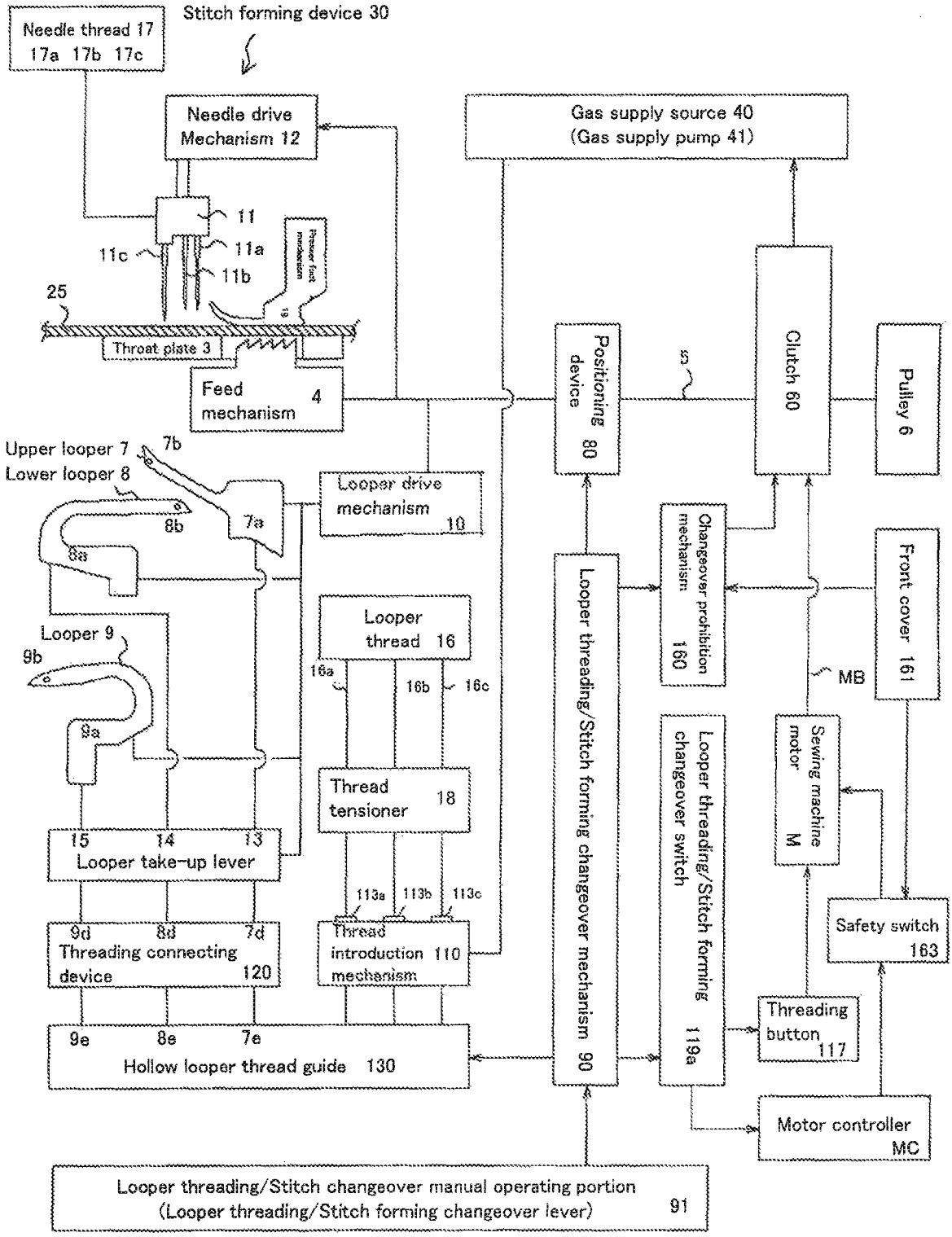
FIG. 2 A block diagram of a three-needle/six-thread serger (double chain stitch sewing machine) applying a gas carrying threading device of sewing machine by the present invention.

As shown in FIG. 1, FIG. 2, the serger 1 forms the stitch forming device 30 by the needle 11*a*, 11*b*, 11*c* which performs vertical motion by being fixed at the needle clamp 11 which performs the vertical motion in synchronization with the drive shaft 5 and piercing the throat plate 3, the needle drive mechanism 12 which drives these needle 11*a*, 11*b*, 11*c*, the presser foot mechanism 19 which presses the cloth 25 on the throat plate 3, the lower looper 8 which traces the arc-like trajectory which intersects with the trajectory of the needle 11*a*, 11*b*, 11*c* at the under side of the throat plate 3 and reciprocates, the upper looper 7 which traces the oval trajectory which intersects with the trajectory of the lower looper 8 at the side of the throat plate 3 and intersects with the trajectory of the needle 11*a*, 11*b*, 11*c* at the upper side of the throat plate 3 and reciprocates, the looper 9 and the cloth feed mechanism 4 which forwards the cloth 25 every one stitch.

The upper looper 7, the lower looper 8 and the looper 9 are respectively driven by the looper drive mechanism 10.

Although the needle drive mechanism 12, the cloth feed mechanism 4 and the looper drive mechanism 10 of the stitch forming device 30 are driven by the drive shaft 5, because the concrete structure and the motion are publicly known or well-known, the detailed explanation is omitted.

According to the three-needle/six-thread serger 1, an overlock stitch is formed on the cloth 25 by intersecting with the needle thread 17*a*, 17*b* which is inserted to the needle 11*a*, 11*b*, a lower looper thread 16*b* which is inserted to the lower looper 8 and an upper looper thread 16*a* which is inserted to the upper looper 7. In addition, the looper 9 forms a 401 type stitch (double chain stitch) on the cloth 25 by intersecting with a looper thread 16*c* which is inserted to the looper 9 and a needle thread 17*c* which is inserted to the needle 11*c*, and performs a so-called interlock stitch.

Figure 4:
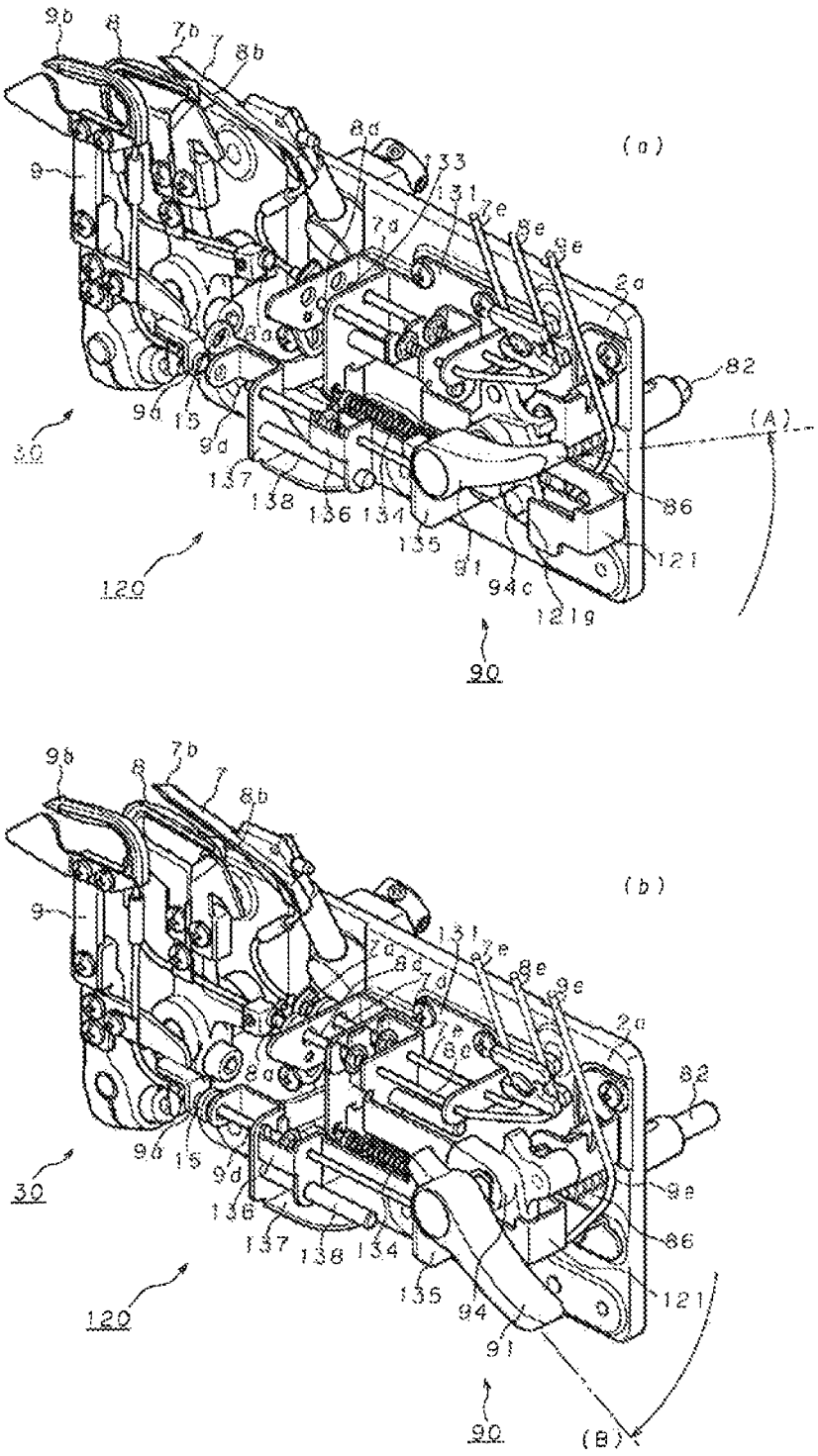
FIG. 4 A perspective view showing a threading connecting device, a hollow looper thread guide, and a looper threading/stitch forming changeover mechanism which are used in a gas carrying threading device of sewing machine by the present invention, and (a) is a stitch forming state and (b) is a threading state.
Figure 5A:
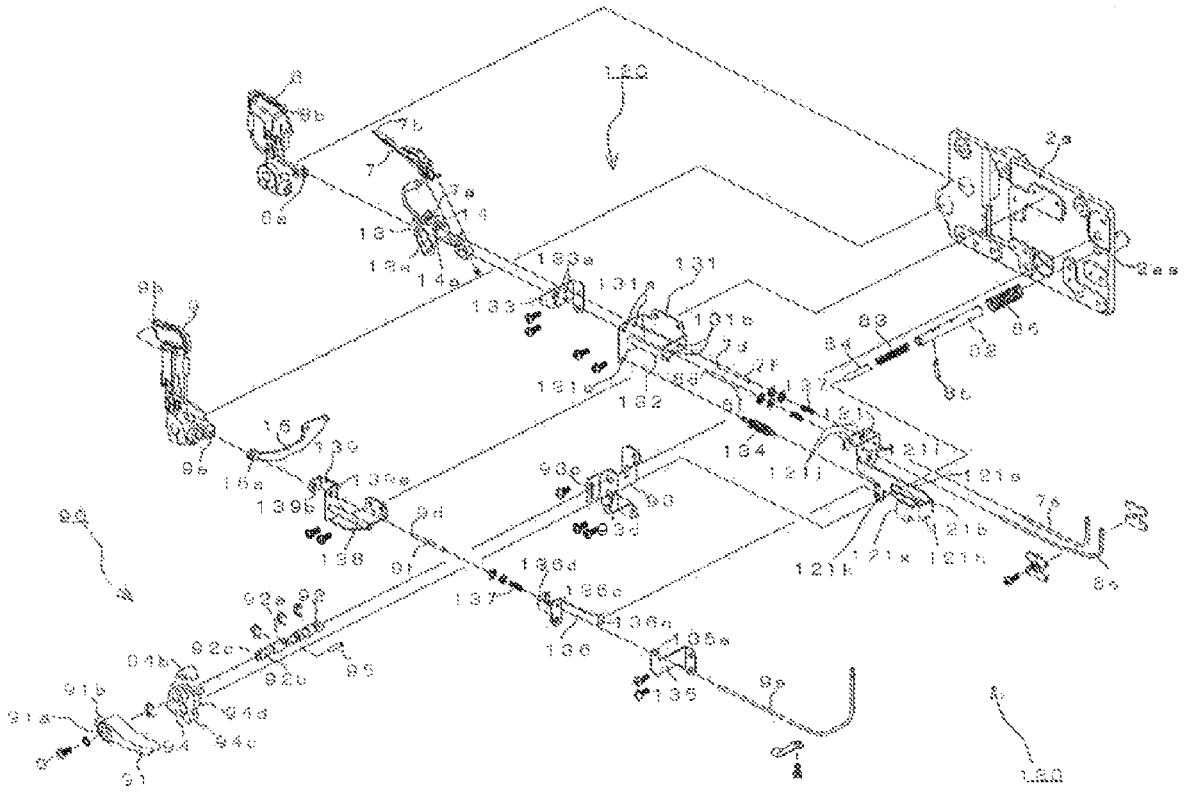
FIG. 5 (A) An exploded perspective view showing a threading connecting device, a hollow looper thread guide, and a looper threading/stitch forming changeover mechanism which are used in a gas carrying threading device of sewing machine by the present invention.
Figure 5B:
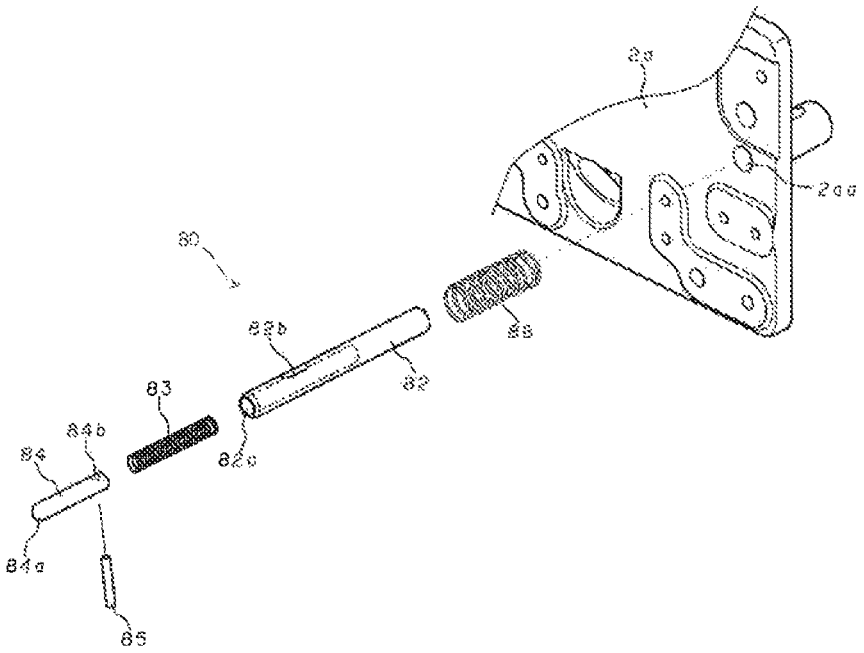

In this serger 1, when inserting each looper thread 16*a*, 16*b*, 16*c* to the upper looper 7, the lower looper 8 and the looper 9 through a thread tensioner 18 by the gas carrying, the upper looper 7, the lower looper 8 and the looper 9 are the hollow structures from looper thread inlet 7*a*, 8*a*, 9*a* to looper loop-taker point thread outlet 7*b*, 8*b*, 9*b* (FIGS. 4 (*a*), (*b*), FIG. 5 (A)). Here, "hollow structure" may compose the looper itself as the hollow structure from the looper thread inlet 7*a*, 8*a*, 9*a* to the looper loop-taker point thread outlet 7*b*, 8*b*, 9*b* and may compose the structure that a groove is formed in the looper from the looper thread inlet 7*a*, 8*a*, 9*a* to the looper loop-taker point thread outlet 7*b*, 8*b*, 9*b* and that a hollow pipe is embedded in there. In this case, a cross-section of the structure may be a circle or a polygon, and for example, the cross-section may be C-shape that a part lacks.

Figure 3:
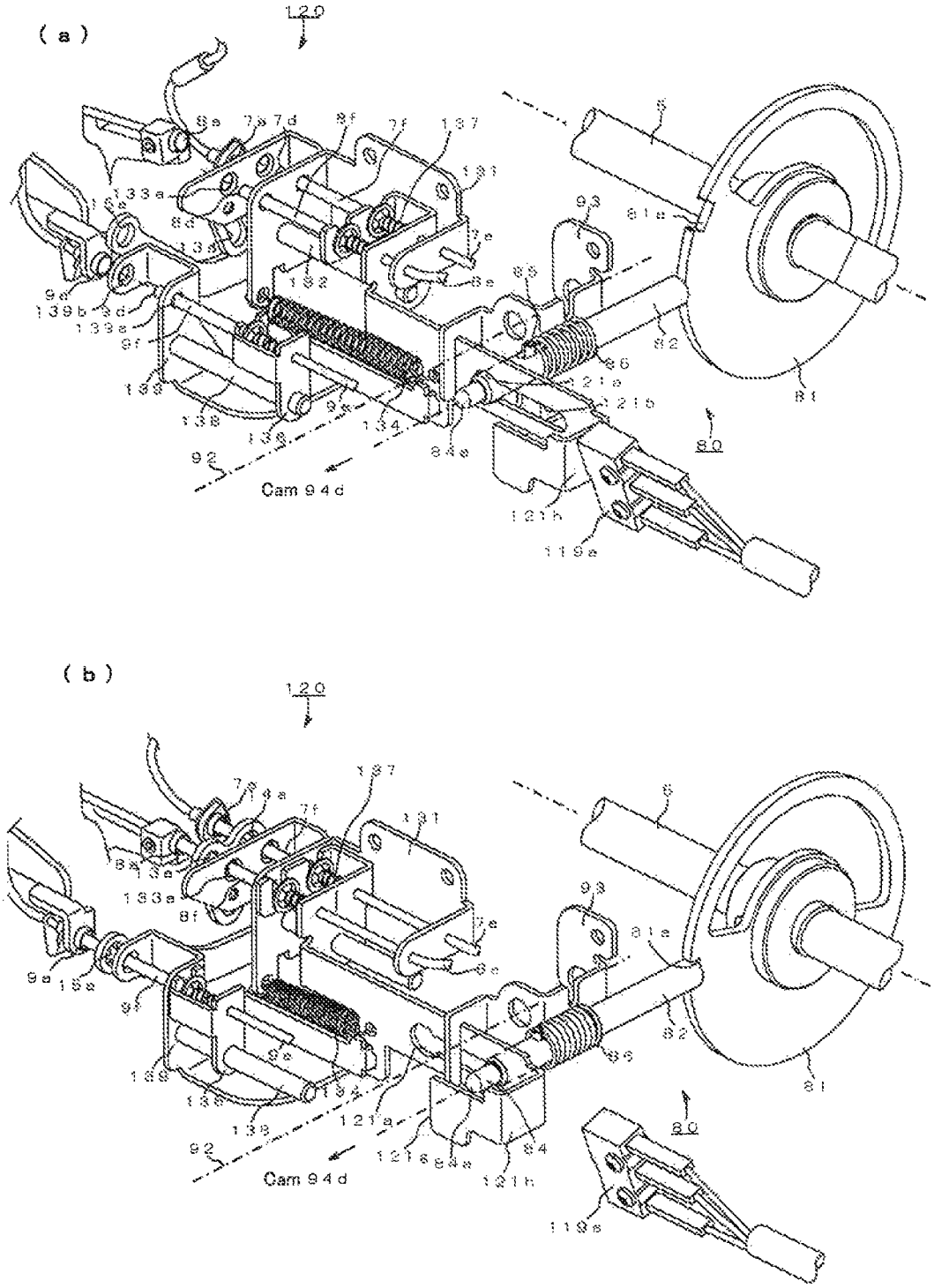
FIG. 3 A partial perspective view showing a threading connecting device, a hollow looper thread guide, and a looper threading/stitch forming changeover mechanism which are used in a gas carrying threading device of sewing machine by the present invention, and (a) is a threading preparatory state and (b) is a threading state.
Figure 6:
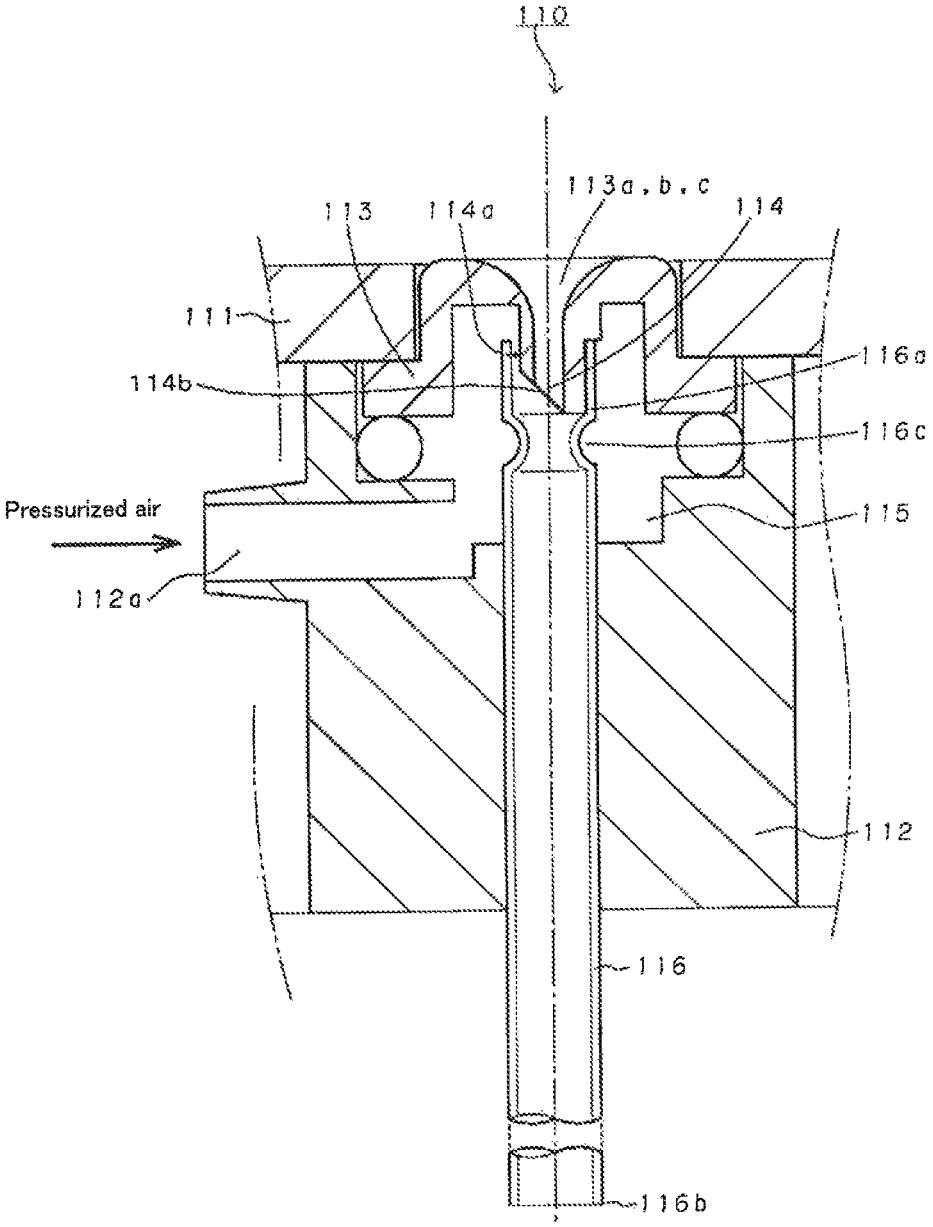
FIG. 6 An explanatory view showing a looper thread introduction mechanism which is used in a gas carrying threading device of sewing machine by the present invention.
Figure 7:
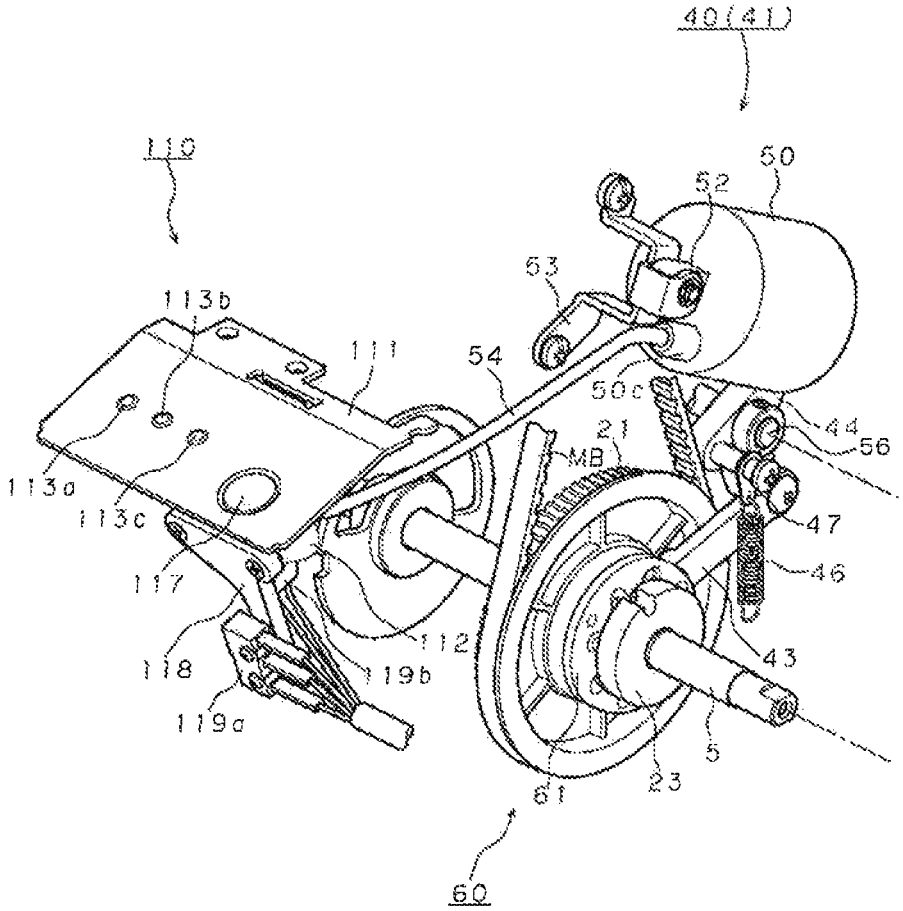
FIG. 7 A perspective view showing a gas supply pump and a looper thread introduction mechanism that a gas is supplied by the gas supply pump which are used in a gas carrying threading device of sewing machine by the present invention.
Figure 8:
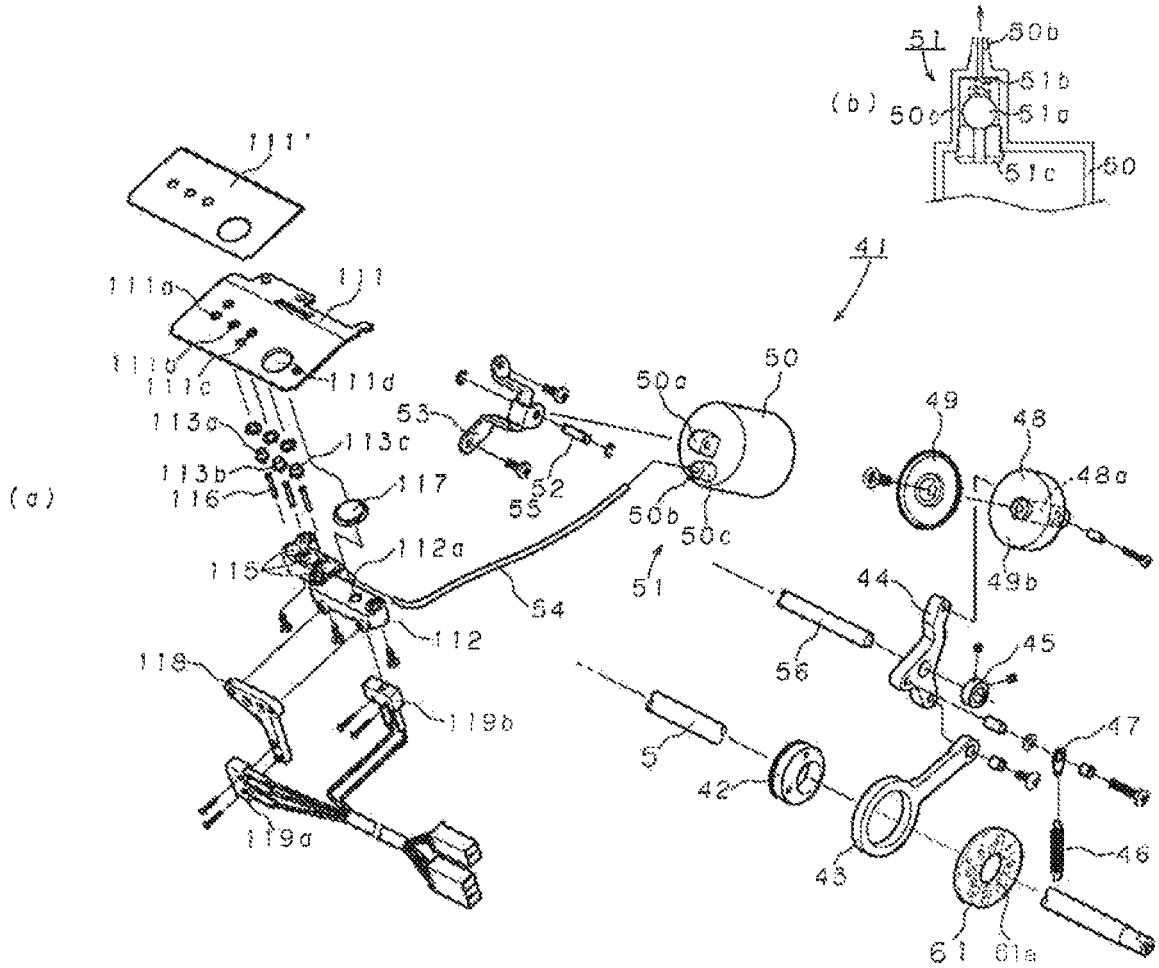
FIG. 8 (*a*) is an exploded perspective view showing a clutch, a gas supply pump which is driven through a clutch and a looper thread introduction mechanism that a gas is supplied by a gas supply pump which are used in a gas carrying threading device of sewing machine by the present invention, and (*b*) is an explanatory view of a back flow stopper valve which is used in a gas supply pump.

For this purpose, the serger 1 is equipped with the looper thread introduction mechanism 110 which inserts each looper thread which is led to the upper looper 7, the lower looper 8 and the looper 9, the hollow looper thread guide 7*e*, 8*e*, 9*e* which extends from the looper thread introduction mechanism 110 to the looper thread inlet 7*a*, 8*a*, 9*a* and has the looper thread guide outlet 7*d*, 8*d*, 9*d* and a gas supply source 40 that the looper threading of each looper thread is performed from the looper thread introduction mechanism 110 to the looper thread guide outlet 7*d*, 8*d*, 9*d* through the hollow looper thread guide 7*e*, 8*e*, 9*e* by the gas carrying (FIG. 1, FIGS. 3 (*a*), (*b*), FIGS. 4 (*a*), (*b*), FIG. 6, FIG. 7, FIG. 8).

As shown in FIG. 6, the looper thread introduction mechanism 110 has wide-mouthed looper thread insertion slot 113*a*, 113*b*, 113*c* which insert each looper thread and a looper thread inhalation area 114 which leads to the wide-mouthed looper thread insertion slots 113*a*, 113*b*, 113*c*, a gas buffer area 115 that the pressurized gas is supplied from the gas supply source 40 and a looper thread introduction pipe 116 which is fitted to the looper thread inhalation area 114 at one end part 116*a* and is connected to the hollow looper thread guide 7*e*, 8*e*, 9*e* at the other end part 116*b*.

The looper thread inhalation area 114 and the looper thread introduction pipe 116 form a ventilation narrow area 114*a* which leads to the gas buffer area 115 and generates a jet stream in a downstream portion of the looper thread inhalation area 114.

A looper thread guide outlet end 114*b* of the looper thread inhalation area 114 is formed slantingly, thereby the generation of a vortex flow in the downstream side of the ventilation narrow area 114*a* is prevented.

A bottleneck portion 116*c* is formed in the inside of the looper thread introduction pipe 116 which is adjacent to the looper thread inhalation area 114 in the downstream side of the ventilation narrow area 114*a*, and therefore, the gas flow in the ventilation narrow area 114*a* is promoted by reducing the pressure of the downstream side of the bottleneck portion 116*c* and the looper thread is inhaled into the looper thread introduction pipe 116 by generating the negative pressure in the looper thread inhalation area 114, and the gas carrying can be performed to the looper loop-taker point thread outlet 7*b*, 8*b*, 9*b* of the upper looper 7, the lower looper 8 and the looper 9 through the hollow looper thread guide 7*e*, 8*e*, 9*e*.

As shown in FIG. 7 and FIG. 8, the looper thread introduction mechanism 110 is formed on a looper thread introduction pedestal 112. Besides, a threading button 117 is formed at the looper thread introduction pedestal 112. Looper thread inset slot 111*a*, 111*b*, 111*c* and a threading button hole 111*d* where the wide-mouthed looper thread insertion slot 113*a*, 113*b*, 113*c* and the threading button 117 face are provided at a thread insert plate 111, and is fixed at the main frame 2, and a thread inset plate seal 111' is pasted on that upper surface.

A threading switch 119*b* which operates by the push of the threading button 117 is provided on the looper thread introduction pedestal 112 and an attaching arm 118 together with an after-mentioned looper threading/stitch forming changeover switch 119*a* which operates by the operation of a looper threading/stitch forming changeover manual operating portion 91 of a looper threading/stitch forming changeover mechanism 90 (FIG. 7, FIG. 8).

As described below, the looper thread guide outlet 7*d*, 8*d*, 9*d* and the looper thread inlet 7*a*, 8*a*, 9*a* are disposed at the time of the looper threading and at the time of the sewing by the sewing machine so that contact/separation becomes free respectively.

In the serger 1, as described below, the looper threading and the sewing by sewing machine are performed by utilizing the upper looper 7, the lower looper 8 and the looper 9 which are the hollow structures from the above-mentioned looper thread inlet 7*a*, 8*a*, 9*a* to the looper loop-taker point thread outlet 7*b*, 8*b*, 9*b*, the looper thread introduction mechanism 110 which inserts the looper thread which is led to the upper looper 7, the lower looper 8 and the looper 9, and the hollow looper thread guide 7*e*, 8*e*, 9*e* which extends from the looper thread introduction mechanism 110 to the looper thread inlet 7*a*, 8*a*, 9*a* and has the looper thread guide outlet 7*d*, 8*d*, 9*d*.

As shown in FIG. 1 and FIG. 2, the serger 1 is equipped with the gas supply pump 41 which is the gas supply source 40 that the looper threading is performed in each looper thread by the gas carrying from the looper thread introduction mechanism 110 to the looper thread guide outlet 7*d*, 8*d*, 9*d* through the hollow looper thread guide 7*e*, 8*e*, 9*e*, the clutch 60 for respectively transmitting the power from the sewing machine motor M to the drive shaft 5 which drives the stitch forming device 30 including the upper looper 7, the lower looper 8 and the looper 9 at the time of the stitch formation or to the gas supply pump 41 at the time of the looper threading, and the looper threading/stitch forming changeover mechanism 90 for changing over the clutch 60 so that the transmission of the power to the stitch forming device 30 is interrupted and the power is transmitted to the gas supply pump 41 at the time of the looper threading and the power is transmitted to the stitch forming device 30 and the transmission of the power to the gas supply pump 41 is interrupted at the time of the stitch formation.

As shown in FIGS. 8 (*a*), (*b*), at the time of the looper threading, the gas supply pump 41 comprises a piston 48 which reciprocate by a pump drive arm 44 which is supported by a spindle 56 which is fixed at the main frame 2 because a pump drive rod 43 reciprocates by a pump drive (eccentric) cam 42 which is rotated by a pump drive member 61 of the clutch 60 (FIG. 7, FIG. 9, FIG. 12), a piston cap 49, a pump cylinder 50 that these slide in the airtight state, and that back flow stopper valve 51. A cylinder attaching portion 50*a* is attached by a pump attaching pedestal 53 at the sub-frame 2*b* so that the swing is allowed by a cylinder attaching pin 52.

Figure 10:
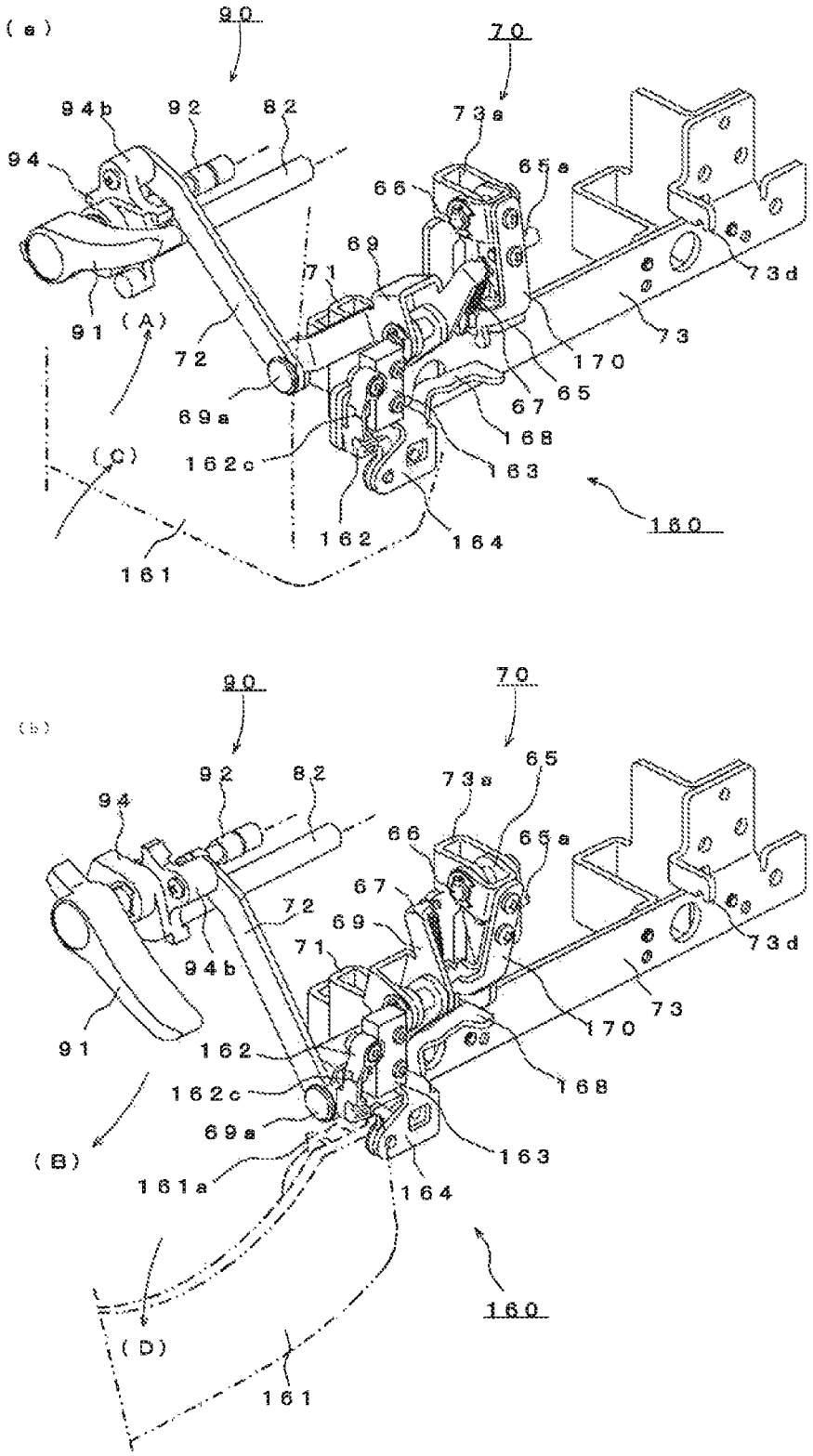
FIGS. 10 (*a*), (*b*) are perspective views showing a looper threading/stitch forming changeover mechanism which is used in gas carrying threading device of sewing machine by the present invention at the time of a stitch formation and at the time of a looper threading respectively.
Figure 11:
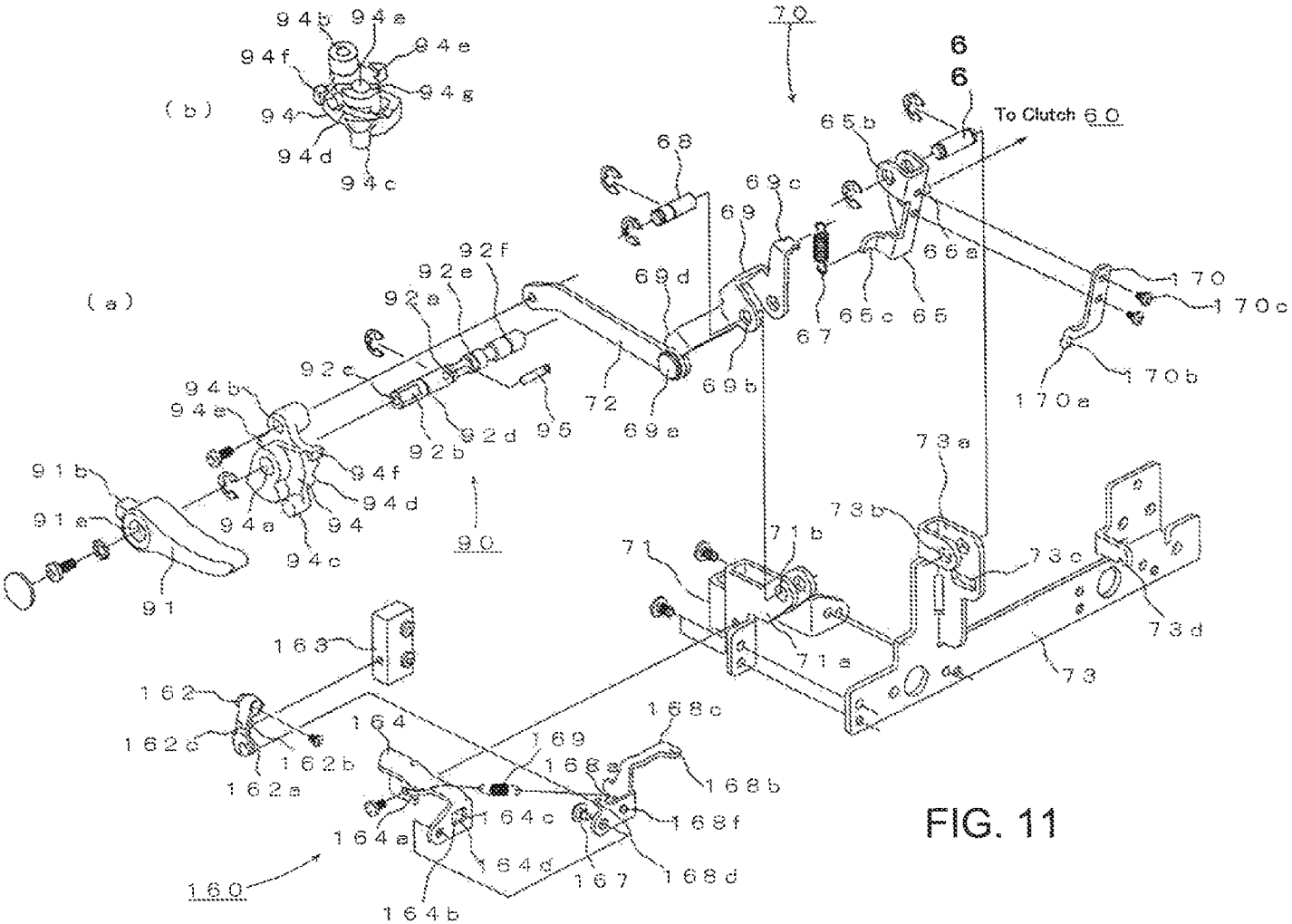
FIG. 11 (*a*) is an exploded perspective view showing a looper threading/stitch forming changeover mechanism and a clutch changeover transmitter which are used in gas carrying threading device of sewing machine by the present invention, (*b*) is a perspective view showing a looper threading/stitch forming changeover cam which is used in a looper threading/stitch forming changeover mechanism.

When the transmission of the power to the gas supply pump 41 is interrupted by stretching and providing a pump drive spring 46 (FIG. 8 (*a*)) to a spring stud 47 of the pump drive arm 44 and a spring stud 73*d* of a clutch changeover pedestal 73 (FIGS. 10 (*a*), (*b*), FIG. 11), an idling of the pump drive (eccentric) cam 42 by the friction with a rotary drive member 23 which is always rotating is prevented, and the function which assists the piston 48 at the time of the pressurization (forward) process is accomplished.

The piston 48 is attached at a piston shaft 48*a* and the piston cap 49 which is formed with the folding-fan shape toward the discharge direction and is the seal material is fixed at a piston head portion 48*b*.

The back flow stopper valve 51 is equipped with a spring 51*b*, a back flow stopper ball 51*a* which is pressed by the spring 51*b*, and a valve seat 51*c* which is screwed at a valve housing 50*c* and closes the valve by seating the back flow stopper ball 51*a* by pressing the spring 51*b* at the time of the return (inhalation) process and opens the valve by floating the back flow stopper ball 51*a* by the delivery pressurized air at the time of the pressurization (forward) process in the valve housing 50*c* which is connected to the pump cylinder 50 and a delivery port 50*b*.

In the operation of the gas supply pump 41, concerning the forward process of the piston 48, the piston cap 49 is connected to the inner wall surface of the pump cylinder 50 in the airtight state, and the air is compressed, and pressurized and injected as the compressed air from the delivery port 50*b* to an air inlet 112*a* (FIG. 6, FIG. 8) of the looper thread introduction mechanism 110 through the pipe 54. On the other hand, in the return (inhalation) process of the piston 48, because the piston cap 49 is not connected to the inner wall surface of the pump cylinder 50 in the airtight state, the air is inhaled through the outer circumference of the piston 48 and the piston cap 49, and the back flow of the air which is sent from the delivery port 50*b* is prevented by the back flow stopper ball 51*a* of the back flow stopper valve 51.

As shown in FIG. 1, FIG. 2 and FIG. 12, the clutch 60 has the pump drive member 61 which transmits the power to the gas supply pump 41, and a clutch slider 62 which is moved so that contact/separation becomes free through a clutch changeover spring 67 depending on a manual operation of a looper threading/stitch forming changeover manual operating portion (looper threading/stitch forming changeover manual lever) 91 to one of a stitch forming drive member 64 which is fastened to the one end of the drive shaft 5 and that the power is transmitted to the stitch forming device 30, and that the contact/separation state is held and the power from the sewing machine motor M is transmitted.

As discussed in detail, the clutch 60 is composed by so-called pin clutch, and a drive shaft pulley 21 that the power from the sewing machine motor M is transmitted by the timing belt MB, a drive shaft pulley boss 22, the pump drive (eccentric) cam 42, the pump drive member 61, the rotary drive member 23, the clutch slider 62 which houses a clutch connecting pin 63 inside coaxially and slidably, the stitch forming drive member 64 and a pulley 6 are provided in sequence on the shaft line of the drive shaft 5.

Figure 9:
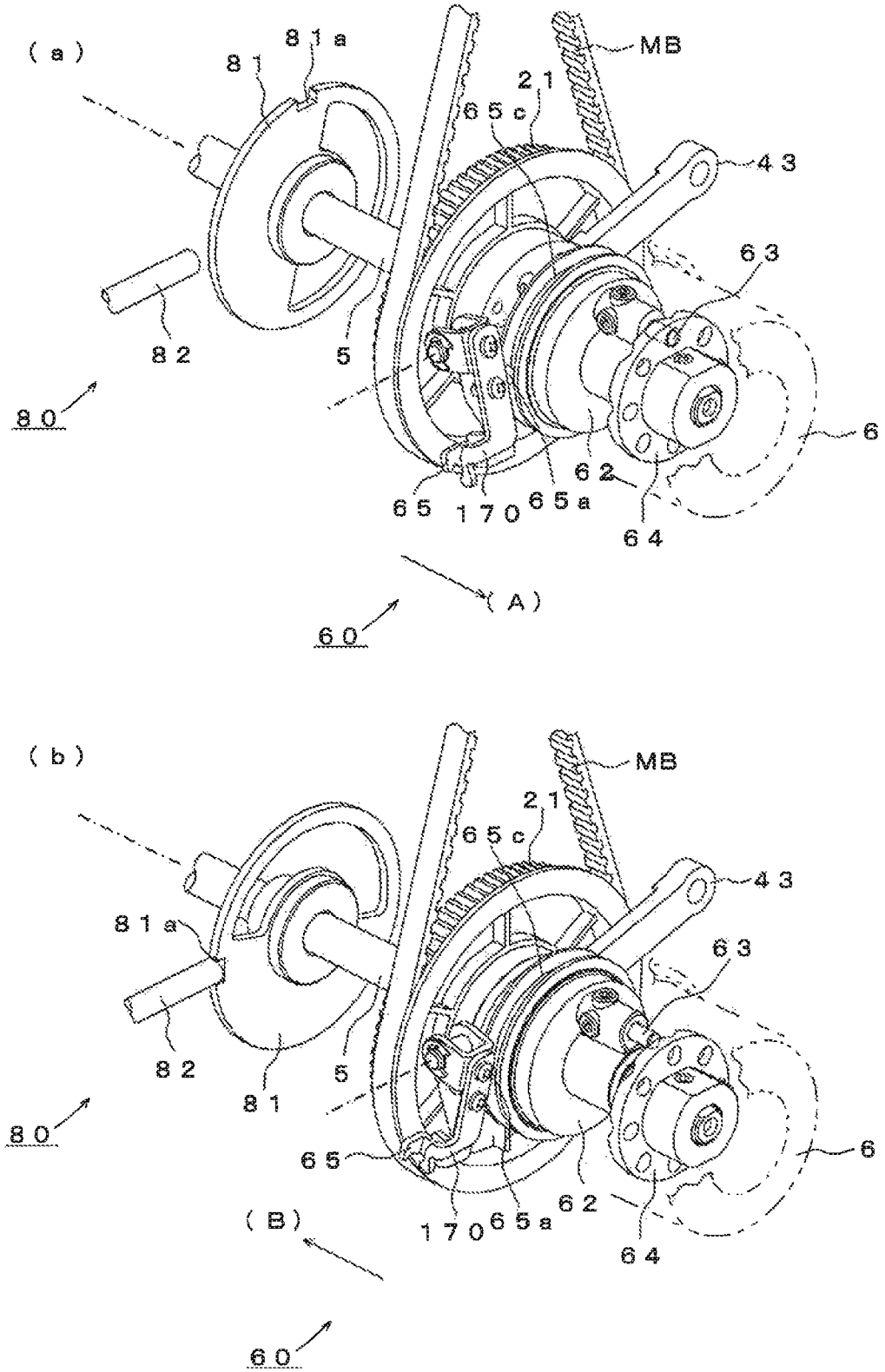
FIGS. 9 (*a*), (*b*) are perspective views showing a clutch and a positioning device which are used in a gas carrying threading device of sewing machine by the present invention at the time of a stitch formation and at the time of a looper threading respectively.

In the operation of the clutch 60 which is composed in this way, at the time of the looper threading, the clutch slider 62 slides to the pump drive member 61 side, and the clutch connecting pin 63 connects to a connecting pin hole 61*a* of the pump drive member 61 with the rotary drive member 23, and the gas supply pump 41 can be driven by a pump drive rod 43 by the pump drive (eccentric) cam 42 (FIG. 9 (*b*)).

At the time of the stitch formation, the clutch slider 62 slides to the pulley 6 side, and the clutch connecting pin 63 connects to a connecting pin hole of the stitch forming drive member 64 with the rotary drive member 23, and the drive shaft 5 can be rotated (FIG. 9 (*a*)).

In the serger 1, as shown in FIGS. 10 (*a*), (*b*) and FIGS. 11 (*a*), (*b*), the looper threading/stitch forming changeover mechanism 90 has the clutch changeover transmitter 70 which changes over the clutch 60 so that the power is transmitted to the gas supply pump 41 at the time of the looper threading, that is, a looper threading/stitch forming changeover cam 94 which is rotated by the looper threading/stitch forming changeover manual operating portion (looper threading/stitch forming changeover manual lever) 91, a clutch changeover link 72 whose one end is pivotally attached at a clutch changeover connecting arm 94*b* of the looper threading/stitch forming changeover cam 94 and reciprocates, a clutch changeover lever 69 that the other end of the clutch changeover link 72 is screwed by a swaging pin 69*a* and thereby swings, a clutch changeover arm 65 which swings to the axial direction of the drive shaft 5 by the clutch changeover spring 67 which is stretched between a changeover spring stud 69*c* of the clutch changeover lever 69 and a changeover spring stud 65*c* of the clutch changeover arm 65, and a clutch changeover pin 65*a* which is fixed to the clutch changeover arm 65 and fits to a slider control groove 62*c* of the clutch slider 62 and changes over the clutch 60 by sliding the clutch slider 62 to the axial direction of the drive shaft 5 by the swing of the clutch changeover arm 65.

The looper threading/stitch forming changeover manual operating portion (looper threading/stitch forming changeover manual lever) 91 is screwed up to a screw hole 92*c* by a screw so that the rotation is stopped in a rotary flatness portion 92*b* of one end portion of a changeover cam shaft 92 which is pivotally attached at the sub-frame 2*a* and a changeover cam shaft backup plate 93. The looper threading/stitch forming changeover cam 94 is fixed by fitting the pin 95 to the pin hole 92*a* of the changeover cam shaft 92.

The clutch changeover lever 69 is pivotally attached by a clutch changeover lever shaft 68 astride a clutch changeover lever attaching arm 71*a* of a clutch changeover lever supporting pedestal 71. The clutch changeover spring 67 is stretched between a clutch changeover lever spring stud 69*c* of the clutch changeover lever 69 and a clutch changeover arm spring stud 65*c* of the clutch changeover arm 65.

The clutch changeover pin 65*a* which changes over the clutch 60 is implanted to the clutch changeover arm 65.

The clutch changeover lever supporting pedestal 71 is fixed to one end of the clutch changeover pedestal 73 which is fastened at the main frame 2.

In the clutch changeover arm 65, the clutch changeover arm attaching hole 65*b* is pivotally attached at a clutch changeover arm attaching hole 73*b* of a clutch changeover arm supporting pedestal 73*a* of the clutch changeover pedestal 73 by a clutch changeover lever shaft 66. A through-hole 73*c* which allows the swing of the clutch changeover pin 65*a* depending on the swing of the clutch changeover arm 65 and moves the clutch changeover pin 65*a* freely is holed and provided at the clutch changeover pedestal 73.

Here, when rotating the looper threading/stitch forming changeover manual operating portion (looper threading/stitch forming changeover manual lever) 91 in a clockwise direction B (looper threading side), the clutch changeover lever 69 is driven by the clutch changeover link 72 and rotates in a counterclockwise direction, and the clutch changeover arm 65 is elastically repelled (stretched) by the clutch changeover spring 67, and one stable state is held by rotating in a clockwise direction. Therefore, the clutch changeover pin 65*a* fits to the slider control groove 62*c*, and the clutch slider 62 slides to the pump drive member 61 side, and the clutch connecting pin 63 connects to the connecting pin hole 61*a* of the pump drive member 61 by sliding a drive groove 23*a* of the rotary drive member 23, and the gas supply pump 41 can be operated and the looper threading can be performed (FIGS. 9 (*b*), FIG. 10 (*b*)). Besides, the looper threading preparatory state of this clutch is held.

On the other hand, when rotating and returning the looper threading/stitch forming changeover manual operating portion (looper threading/stitch forming changeover manual lever) 91 in the counterclockwise direction A (stitch formation side), the clutch changeover lever 69 is driven by the clutch changeover link 72 and rotates in the clockwise direction, and the clutch changeover arm 65 is elastically repelled (stretched) by the clutch changeover spring 67, and the other stable state is held by rotating in the counterclockwise direction. The clutch changeover pin 65*a* fits to the slider control groove 62*c* by the clutch changeover spring 67 and the clutch slider 62 slides to the stitch forming drive member 64 side, and the clutch connecting pin 63 connects to a connecting pin hole 64*a* of the stitch forming drive member 64 by sliding a drive groove 23*a* of the rotary drive member 23, and the drive shaft 5 can be rotated and the stitch formation can be performed (FIGS. 9 (*a*), FIG. 10 (*a*)). Besides, the stitch forming preparatory state of this clutch is held. That is, the clutch changeover spring 67 accomplishes the function which moves the clutch slider 62 to one of the pump drive member 61 which transmits the power to the gas supply pump 41 and the stitch forming drive member 64 which is fastened at one end of the drive shaft 5 and transmits the power to the stitch forming device 30 so that contact/separation becomes free depending on the manual operation of the looper threading/stitch forming changeover manual operating portion (looper threading/stitch forming changeover manual lever) 91 and which holds the contact/separation state.

Besides, the looper threading/stitch forming changeover cam 94 has a pin advance/retreat cam 94*d* for advancing and retreating an after-mentioned positioning pin for a stop positioning plate 81 and connecting a threading connecting device 120 (FIG. 1-FIG. 5), and a releasing cam 94*c* for separating the looper thread guide outlet 7*d*, 8*d*, 9*d* and the looper thread inlet 7*a*, 8*a*, 9*a* by releasing the threading connecting device 120.

When repeating, as shown in FIGS. 3 (*a*), (*b*), FIG. 5 (A) and FIG. 11, the serger 1 is equipped with the threading connecting device 120 (FIG. 1-FIG. 5) that the looper thread guide outlet 7*d*, 8*d*, 9*d* and the looper thread inlet 7*a*, 8*a*, 9*a* are disposed so that contact/separation becomes free respectively at the time of the looper threading and the stitch formation depending on the manual operation of the looper threading/stitch forming changeover manual operating portion 91.

In the threading connecting device 120, looper thread guide connecting plate 121, 136, looper thread guide outlet support 131, 139 and looper thread take-up lever thread guide 133, 139*b* are provided. These are fastened at the sub-frame 2*a*.

The hollow looper thread guide 7*e*, 8*e*, 9*e* of a hollow looper thread guide 130 which extends from the looper thread introduction mechanism 110 (FIG. 6) form looper thread passes through supporting hole 131*b*, 135*a*, supporting hole 121*i*, 136*c*, spring receiving groove 121*j*, 136*d*, supporting hole 131*a*, 139*a* and thread take-up lever thread guide 133*a*, 139*b* respectively by being inserted to the hollow looper thread guide 7*f*, 8*f*, 9*f* with nested state. Pressure-expanding spring 137 is provided between the supporting hole 121*i*, 136*c* and the spring receiving groove 121*j*, 136*d*, and is latched together at the spring receiving groove 121*j*, 136*d* by fastening ring, and the hollow looper thread guide 7*f*, 8*f*, 9*f* is elastically repelled to the looper side. Therefore, the hollow looper thread guide 7*f*, 8*f*, 9*f* is held slidably at the spring receiving groove 121*j*, 136*d* and the supporting hole 131*a*, 139*a* respectively, and the looper thread guide outlet 7*d*, 8*d*, 9*d* and the looper thread inlet 7*a*, 8*a*, 9*a* of the upper looper 7, the lower looper 8 and the looper 9 can contact and separate.

In addition, connecting plate guide bar 132, 138 which support the looper thread guide connecting plate 121, 136 is provided.

A spring 134 is stretched and provided between a spring stud 121*k* of the looper thread guide connecting plate 121 and a spring stud 131*c* of the looper thread guide outlet support 131, and thereby because the looper threading/stitch forming changeover manual operating portion (looper threading/stitch forming changeover manual lever) 91 is rotated to the clockwise direction B (looper threading side), the releasing cam 94*c* releases looper thread pass separated state through a cam follower 121*g* of the looper thread guide connecting plate 121, and when connecting the threading connecting device 120, the hollow looper thread guide 7*f*, 8*f*, 9*f* is elastically repelled to the looper side, and the looper thread guide outlet 7*d*, 8*d*, 9*d* and the looper thread inlet 7*a*, 8*a*, 9*a* are connected in the thread pass.

Besides, as shown in FIG. 2, FIGS. 3 (*a*), (*b*), FIGS. 4 (*a*), (*b*), FIGS. 9 (*a*), (*b*), FIG. 12, FIGS. 13 (*a*), (*b*), (*c*), the serger 1 is equipped with a positioning device 80 which functions as the safety device.

As shown in FIGS. 3 (*a*), (*b*), FIGS. 4 (*a*), (*b*), the positioning device 80 has the stop positioning plate 81 which is coaxially attached at the drive shaft 5 and has a notch 81*a* at the stop position of the circumferential direction for aligning the positions of the looper thread guide outlet 7*d*, 8*d*, 9*d* and the looper thread inlet 7*a*, 8*a*, 9*a* horizontally and the positioning pin 82 which connects the threading connecting device 120 which can fit to the notch 81*a* by rotating the pulley 6 manually at the time of the looper threading that the looper threading/stitch forming changeover manual operating portion (looper threading/stitch forming changeover manual lever) 91 is changed over and operated manually to the looper threading side and which is disposed so that contact/separation becomes free at the time of the looper threading and the stitch formation respectively (FIG. 5 (A), FIG. 5 (B)).

The positioning device 80 is equipped with a follower pin 84 which has a follower pin end 84*a* which engages to the pin advance/retreat cam 94*d* of the looper threading/stitch forming changeover cam 94 and the positioning pin 82 that the follower pin 84 is fitted in through a follower pin spring 83. The follower pin 84 becomes slidable by a guide pin 85 through the follower pin spring 83 in the inside of an elongate hole 82*b*. A positioning pin back spring 86 is provided between the guide pin 85 and the sub-frame 2*a* in the positioning pin 82, and the positioning pin 82 is elastically repelled toward the looper threading/stitch forming changeover cam 94.

The positioning pin 82 pierces a positioning pin slide hole 2*aa* and extends toward the positioning plate 81. The follower pin 84 and the positioning pin 82 that this fits are fitted in a shaft hole 121*a* leading to an elongate hole 121*b* of the looper thread guide connecting plates 121 with the looper thread pass separated state.

Further, in the gas carrying threading device of sewing machine of the present invention, as shown in FIG. 1, FIG. 10-FIG. 11, FIG. 14-FIGS. 17 (*a*), (*b*), the changeover prohibition mechanism 160 for prohibiting the abnormal changeover to the stitch forming state of the looper threading/stitch forming changeover mechanism 90 during the gas supply operation of the gas supply source 40 (gas supply pump 41) is provided.

In the gas carrying threading device of sewing machine of the present invention, the looper threading/stitch forming changeover manual operating portion (looper threading/stitch forming changeover manual lever) 91 of the looper threading/stitch forming changeover mechanism 90 is hidden by the front cover 161 (FIG. 1, FIG. 10, FIGS. 15 (*a*), (*b*)-FIGS. 17 (*a*), (*b*)) of the sewing machine which can open and close freely. The front cover 161 is opened (D direction, FIG. 10, FIGS. 15 (*a*), (*b*)-FIGS. 17 (*a*), (*b*)) at the time of the looper threading and the looper threading/stitch forming changeover manual operating portion (looper threading/stitch forming changeover manual lever) 91 is changed over to the looper threading state (clockwise direction B, FIG. 10), and after the looper threading/stitch forming changeover manual operating portion (looper threading/stitch forming changeover manual lever) 91 is changed over to the stitch forming state (counterclockwise direction A, FIG. 10), the front cover 161 is closed (C direction, FIG. 10, FIGS. 15 (*a*), (*b*)-FIGS. 17 (*a*), (*b*)), thus the looper threading/stitch forming changeover manual operating portion (looper threading/stitch forming changeover manual lever) 91 of the looper threading/stitch forming changeover mechanism 90 operates the stitch forming device 30 at the time of the stitch formation.

In the gas carrying threading device of sewing machine of the present invention, the changeover prohibition mechanism 160 comprises a front cover opening and closing detection piece 162 which is attached pivotally at the lower end of a front surface cover 171 (FIG. 14-FIG. 17) which is fastened at the main frame 2 and is pivoted by detecting the opening and closing of the front cover 161 depending on the press of a pressing end 161*a* which is formed in the inner surface of the front cover 161 and resisting the elastic repulsion of the spring 169 and is attached pivotally at an axis 172 which is formed at the front surface cover 171, a prohibition active arm 168 which is attached pivotally at a prohibition active arm attaching pedestal 164 which is fixed at the sub-frame 2*b* through the clutch changeover lever supporting pedestal 71 by a swaging pin 167 by resisting the elastic repulsion of the spring 169 and is pivoted depending on the pivot of the front cover opening and closing detection piece 162, and a prohibition driven arm 170 which is fixed at the looper threading/stitch forming changeover mechanism 90 and prohibits the abnormal changeover to the stitch forming state of the looper threading/stitch forming changeover mechanism 90 during the opening of the front cover depending on the pivot of the prohibition active arm 168.

Figure 14:
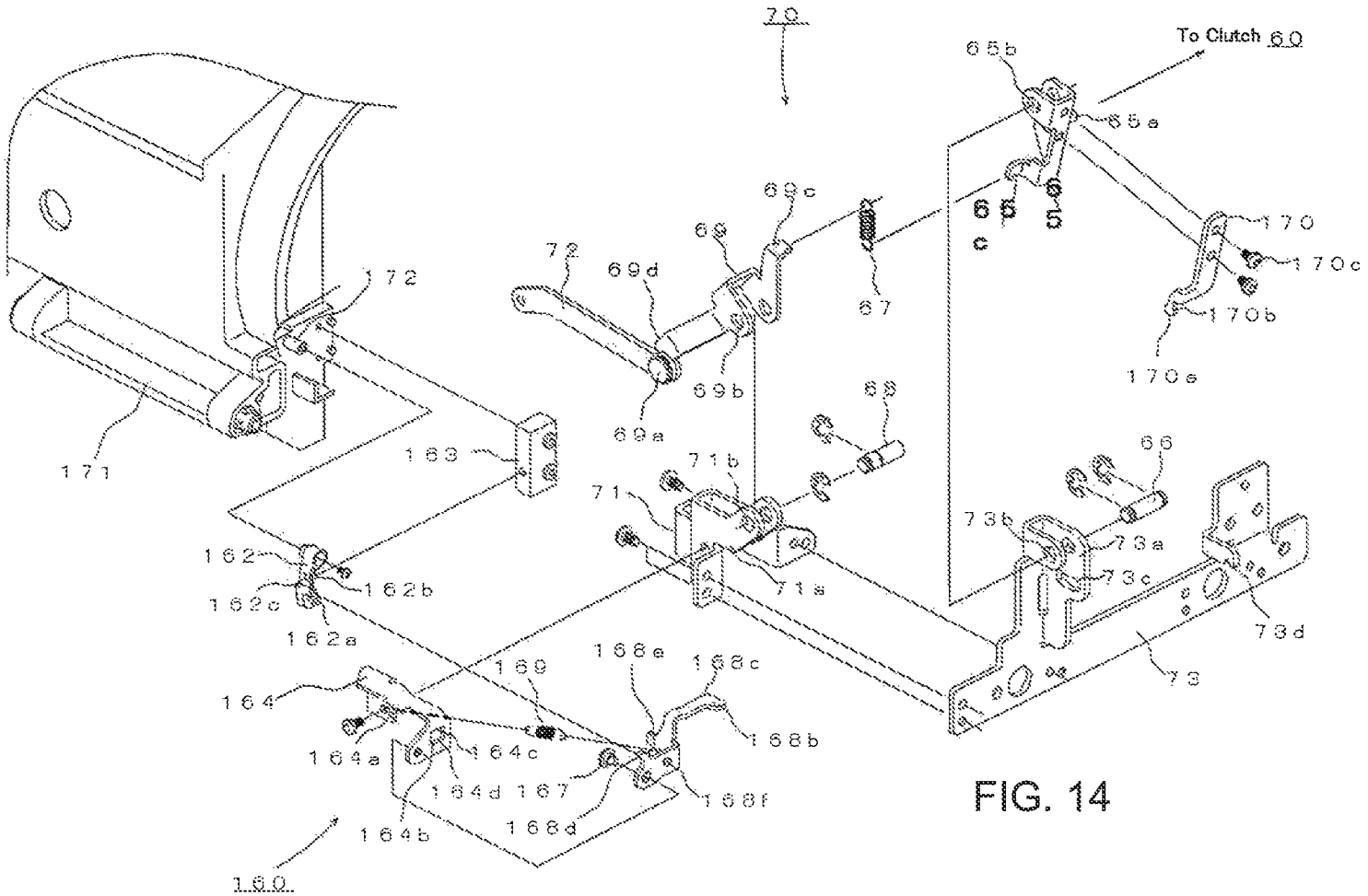
FIG. 14 An exploded perspective view showing a changeover prohibition mechanism which is used in gas carrying threading device of sewing machine by the present invention.

One end 162*b* of the front cover opening and closing detection piece 162 combines the actuator of the safety switch 163, and when the front cover 161 is closed, the front cover opening and closing detection piece 162 of the front cover 161 is pivoted to the counterclockwise direction by the press of the pressing end 161*a* in FIG. 1, FIG. 14, FIGS. 15 (*a*), FIG. 17 (*b*) and the sewing machine motor M becomes ON-state through the safety switch 163, and when the front cover 161 is opened, the sewing machine motor M becomes OFF-state through the safety switch 163 by the release of the press of the pressing end 161*a* of the front cover 161, and the front cover opening and closing detection piece 162 is pivoted from the state of pivoting to the counterclockwise direction in FIG. 1, FIG. 14, FIGS. 15 (*a*), FIG. 17 (*b*) to the clockwise direction freely.

The spring 169 is attached between a spring stud 164*a* of the prohibition active arm attaching pedestal 164 and a spring stud 168*a* of the prohibition active arm 168 and is repelled elastically so as to pivot the prohibition active arm 168 always to the counterclockwise direction in FIG. 1, FIG. 14, FIG. 15-FIG. 17, and a pin 168*f* of the prohibition active arm 168 contacts to an upper end stopper 164*c* of a window 164*b* of the prohibition active arm attaching pedestal 164 and is latched together.

The prohibition driven arm 170 is fixed at the looper threading/stitch forming changeover mechanism 90 and the clutch changeover arm 65 of the clutch changeover transmitter 70 by a screw 170*c*.

The front cover 161 is opened at the time of the looper threading by this changeover prohibition mechanism 160, the front cover opening and closing detection piece 162 pivots to the clockwise direction freely by the release of the press of the pressing end 161*a* which is formed in the inner surface of the front cover 161, the prohibition active arm 168 is pivoted to the counterclockwise direction by the elastic repulsion of the spring 169, a tongue piece 170*a* of the prohibition driven arm 170 is latched together at a tip plane portion 168*b* of the prohibition active arm 168, the looper threading/stitch forming changeover manual operating portion (looper threading/stitch forming changeover manual lever) 91 is changed over to the looper threading state (clockwise direction B), the stitch forming device 30 is locked by rotating the pulley 6 manually, simultaneously, the threading connecting device 120 (FIG. 1-FIG. 5) is operated, the tongue piece 170*a* of the prohibition driven arm 170 is latched together at a side surface portion 168*c* from the tip plane portion 168*b* of the prohibition active arm 168, and the abnormal changeover to the stitch forming state of the looper threading/stitch forming changeover mechanism 90 is prohibited.

On the other hand, at the time of the stitch formation, after the looper threading/stitch forming changeover manual operating portion (looper threading/stitch forming changeover manual lever) 91 is changed over to the stitch forming state (counterclockwise direction A), the front cover 161 is closed and the front cover opening and closing detection piece 162 is pivoted by the press of the pressing end 161*a*, a pressed protrusion 168*d* of the prohibition active arm 168 is pressed by a pressing protrusion 162*a*, the prohibition active arm 168 is pivoted to the clockwise direction by resisting the elastic repulsion of the spring 169, a driven piece 170*a* of the prohibition driven arm 170 is released from the side surface portion 168*c* of the prohibition active arm 168 onto the tip plane portion 168*b* and the changeover to the stitch forming state (counterclockwise direction A) of the looper threading/stitch forming changeover mechanism 90 is activated, and the stitch forming device 30 is operated.

Hereinafter, the operation of the gas carrying threading device of sewing machine which is composed in this way is explained in sequence in more detail.

In now, when performing the looper threading, the front cover 161 is opened, the front cover opening and closing detection piece 162 of the changeover prohibition mechanism 160 is pivoted from the state of pivoting to the counterclockwise direction in FIG. 1, FIG. 14, FIG. 15 (*a*), FIG. 17 (*b*) to the clockwise direction freely by the release of the press of the pressing end 161*a* which is formed in the inner surface of the front cover 161 (FIG. 10 (*b*), FIG. 15 (*b*)), the sewing machine motor M becomes OFF-state by the safety switch 163 by the release of the press of one end 162*b* of the front cover opening and closing detection piece 162, the prohibition active arm 168 is pivoted by the spring 169, and the tongue piece 170*a* of the prohibition driven arm 170 is latched together at the tip plane portion 168*b* of the prohibition active arm 168 and becomes the state that the tongue piece 170*a* is placed onto the tip plane portion 168*b*.

Figure 16:
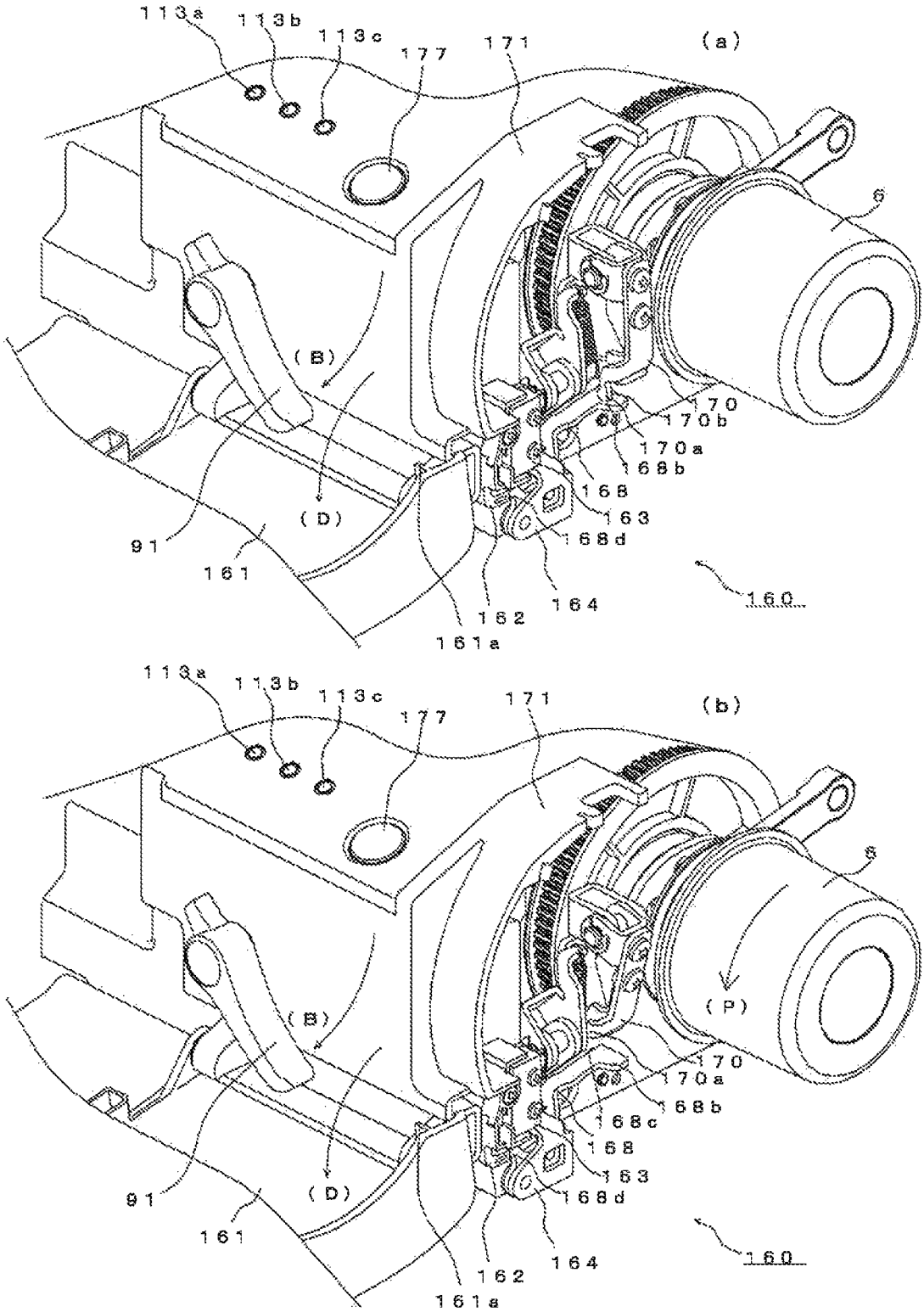
FIGS. 16 (*a*), (*b*) are views showing the relations among the looper threading/stitch forming changeover manual operating portion, the changeover prohibition mechanism and the safety switch in the case that the looper threading/stitch forming changeover manual operating portion is changed over to the looper threading state in the state that the front cover opens respectively, and (b) shows the state which rotates the pulley manually from the state of (a).

The looper threading/stitch forming changeover manual operating portion (looper threading/stitch forming changeover manual lever) 91 of the looper threading/stitch forming changeover mechanism 90 is rotated to the clockwise direction B (looper threading side) (FIG. 10 (*b*), FIG. 13 (*b*), FIG. 16 (*a*)).

This state is an after-mentioned preparation step for prohibiting the abnormal changeover to the stitch forming state of the looper threading/stitch forming changeover mechanism 90.

Simultaneously, a rotational angle of the looper threading/stitch forming changeover cam 94 in the clutch changeover transmitter 70 is inhibited by a lever right rotation stopper 94*f*, and the looper threading/stitch forming changeover cam 94 rotates around the changeover cam shaft 92 of a rotary axis and pushes the clutch changeover link 72 which is attached pivotally at the clutch changeover connecting arm 94*b* (FIG. 10 (*b*)).

The clutch changeover lever 69 which is attached by the clutch changeover lever shaft 68 at a clutch changeover lever attaching hole 71*b* which is provided at the clutch changeover lever supporting arm 71*a* of a clutch changeover lever supporting pedestal 71 is swung to the counterclockwise direction by a pivot point of the swaging pin 69*a* by the push of the clutch changeover link 72.

The clutch changeover arm 65 which is attached at the clutch changeover arm attaching hole 73*b* which is provided at the clutch changeover arm supporting pedestal 73*a* of the clutch changeover pedestal 73 by the clutch changeover arm shaft 66 and the clutch changeover arm attaching hole 65*b* is swung to the clockwise direction through the clutch changeover spring 67. In this case, the clutch changeover pin 65*a* slides in the inside of the through-hole 73*c* which is provided at the clutch changeover arm supporting pedestal 73*a* and positions at a left end (FIG. 9 (*b*)).

As a result, the clutch changeover pin 65*a* fits into the slider control groove 62*c*, the clutch slider 62 of the clutch 60 slides to the pump drive member 61 side, the transmission of the power to the stitch forming device 30 is interrupted, the clutch connecting pin 63 slides in the drive groove 23*a* of the rotary drive member 23 and becomes a connectable state in the connecting pin hole 61*a* of the pump drive member 61. The piston 48 of the gas supply pump 41 can be reciprocated by the pump drive rod 43 and the pump drive arm 44 by the pump drive (eccentric) cam 42 (FIG. 7, FIG. 8 (*a*), FIG. 9 (*b*), FIG. 12).

Concerning the clutch changeover pin 65*a*, by the clutch changeover spring 67, the clutch slider 62 slides and contacts to the pump drive member 61 side, the contact state is held, the gas supply pump 41 for the looper threading can be driven, and the pump drive preparing state is achieved. That is, the clutch 60 holds one clutch stable state by the elasticity of the clutch changeover spring 67.

In this case, the clutch 60 is the pin clutch, and because the clutch connecting pin 63 is fitted easily to the connecting pin hole 61*a* of the pump drive member 61 through the rotary drive member 23, the changeover of the clutch can be performed by the weak lateral pressure and without slipping.

When rotating the looper threading/stitch forming changeover manual operating portion (looper threading/stitch forming changeover manual lever) 91 to the clockwise direction B (looper threading side), in parallel with the changeover of the above-mentioned clutch 60, the releasing cam 94*c* (FIG. 11 (*b*)) which is provided at the looper threading/stitch forming changeover cam 94 releases the engagement with the cam follower 121*g* of the looper thread guide connecting plate 121, in this state, the follower pin 84 and the positioning pin 82 which is fitted into the follower pin 84 is being fitted into the shaft hole 121*a* of the looper thread guide connecting plate 121 (FIG. 3 (*a*)), in the state that the looper thread guide connecting plate 121 is repelled elastically to the looper side, because the follower pin end 84*a* of the follower pin 84 is pressed by the pin advance/retreat cam 94*d*, the positioning pin 82 of the positioning device 80 which pierces the positioning pin slide hole 2*aa* and extends advances and is contacted to the outer peripheral surface of the positioning plate 81 by the follower pin spring 83 and the positioning pin back spring 86 (FIG. 13 (*b*)).

From the above operation, the connecting of the threading connecting device 120 (FIG. 1-FIG. 5) which is arranged so that the connection becomes free at the time of the looper threading and the positioning of the positioning device 80 are prepared.

In such state that the changeover of the clutch 60, the connecting of the threading connecting device 120 (FIG. 1-FIG. 5) and the positioning of the positioning device 80 are prepared, when rotating the pulley 6 which is fastened at one end of the drive shaft 5 manually, the positioning pin 82 is fitted into the notch 81*a* of the positioning plate 81 of the positioning device 80 horizontally at the stop position (FIG. 3 (*b*), FIG. 4 (*b*)) of the circumferential direction for aligning the positions of the looper thread guide outlet 7*d*, 8*d*, 9*d*, the looper thread inlet 7*a*, 8*a*, 9*a* and the thread take-up lever hole 14*a*, 13*a*, 15*a* of the looper thread take-up lever 14, 13, 15, and the rotation of the drive shaft 5 is locked at this aligning position by the positioning pin 82 (FIG. 13 (*c*), FIG. 9 (*b*)).

Because the rotation of the drive shaft 5 is locked by the operation of the positioning plate 81, the positioning device 80 functions as the safety apparatus at the time of the looper threading.

In the first time here, because the clutch slider 62 slides to the pump drive member 61 side, the clutch connecting pin 63 contacts to the surface of the connecting pin hole 61*a* of the pump drive member 61, and the connectable state is accomplished. Accordingly, a looper thread 16 is inserted to the wide-mouthed looper thread insertion slot 113*a*, 113*b*, 113*c*, when the sewing machine motor M becomes ON-state by pushing the threading button 117, the drive shaft pulley 21 that the power from the sewing machine motor M is transmitted by the timing belt MB and the rotary drive member 23 which is fastened through the drive shaft pulley boss 22 rotate, thereby the clutch connecting pin 63 corresponds to the connecting pin hole 61*a* of the pump drive member 61 and is fitted into it and is connected completely, and because the clutch slider 62 further slides to the pump drive member 61 side, also the clutch changeover pin 65*a* further moves to the pump drive member 61 side along with it.

In this state, because the tongue piece 170*a* of the prohibition driven arm 170 in the changeover prohibition mechanism 160 slides on the tip plane portion 168*b* of the prohibition active arm 168 which is repelled elastically to the upper direction by the spring 169 with the movement of the clutch changeover arm 65 depending on the movement of the clutch changeover pin 65*a* and is latched together at a side surface portion 168*c* from the tip plane portion 168*b*, as described below, the abnormal changeover to the stitch forming state of the looper threading/stitch forming changeover mechanism 90 is prohibited (FIG. 17 (*a*) shows the operating state after the looper threading/stitch forming changeover manual operating portion (looper threading/stitch forming changeover manual lever) 91 is operated to the counterclockwise direction A).

Besides, the positioning pin 82 is fitted into the notch 81*a* of the positioning plate 81, thereby the threading connecting device 120 (FIG. 1-FIG. 5) operates, the positioning pin 82 disengages from the shaft hole 121*a* of the looper thread guide connecting plate 121, the looper thread guide connecting plate 121 is elastically repelled to the looper side by the elasticity of the spring 134, and the elongate hole 121*b* of the looper thread guide connecting plates 121 slides on the follower pin 84. In this case, the follower pin 84 is fitted into the elongate hole 121*b* by the positioning pin back spring 83.

Simultaneously, by the elasticity of the spring 134, the looper thread guide connecting plate 121, 136, therefore, the hollow looper thread guide 7*f*, 8*f*, 9*f* which is connected with nested state with the hollow looper thread guide 7*e*, 8*e*, 9*e* of the hollow looper thread guide 130 moves to the side of the upper looper 7, the lower looper 8 and the looper 9 through the supporting hole 131*a*, 139*a* and the thread take-up lever thread guide 133*a*, 139*b*, and the looper thread guide outlet 7*d*, 8*d*, 9*d* and the looper thread inlet 7*a*, 8*a*, 9*a* are connected. In this case, the spring 137 buffers the impact when the looper thread guide outlet 7*d*, 8*d*, 9*d* of the hollow looper thread guide 7*f*, 8*f*, 9*f* and the looper thread inlet 7*a*, 8*a*, 9*a* of the upper looper 7, the lower looper 8 and the looper 9 are connected.

When the looper thread guide connecting plate 121 slides to the looper direction, the looper threading/stitch forming changeover switch 119*a* which is changed over by a switch operational portion 121*h* of the looper thread guide connecting plate 121 is released, and a motor controller MC becomes OFF-state, and the threading button 117 is changed over to the ON-state.

Thereby, the hollow looper thread guide 130 of the threading connecting device 120 (FIG. 1-FIG. 5) becomes the connecting state from the connecting preparatory state (FIG. 3 (*b*), FIG. 4 (*b*)).

In the connecting state of the threading connecting device 120 (FIG. 1-FIG. 5), when inserting each necessary looper thread to the wide-mouthed looper thread insertion slot 113*a*, 113*b*, 113*c* of the looper thread introduction mechanism 110 for about 5-6 mm (¼ inch) (FIG. 1, FIG. 6, FIG. 8) and pushing the threading button 117 of the looper thread introduction pedestal 112, the threading switch 119*b* becomes ON-state and the sewing machine motor M is controlled with the rotation of the constant speed, and the piston 48 of the gas supply pump 41 can be reciprocated by the drive shaft pulley 21 with the timing belt MB, the drive shaft pulley boss 22, the pump drive member 61 from the rotary drive member 23 of the clutch 60, the pump drive cam 42, the pump drive rod 43 and the pump drive arm 44 (FIG. 7, FIG. 8, FIG. 9 (*b*)). In the operation of the gas supply pump 41, concerning the forward process of the piston 48, the piston cap 49 is connected to the inner wall surface of the pump cylinder 50 in the airtight state, and the air is compressed, and pressurized and injected as the compressed air from the delivery port 50*b* to an air inlet 112*a* (FIG. 6, FIG. 8) of the looper thread introduction mechanism 110 through the pipe 54. On the other hand, in the return (inhalation) process of the piston 48, because the piston cap 49 is not connected to the inner wall surface of the pump cylinder 50 in the airtight state and becomes open state, the air is inhaled through the outer circumference of the piston 48 and the piston cap 49, and the back flow of the air which is sent from the delivery port 50*b* is prevented by the back flow stopper ball 51*a* of the back flow stopper valve 51.

The compressed air from the gas supply pump 41 is pressurized and injected from the delivery port 50*b* to the air inlet 112*a* (FIG. 6, FIG. 8 (*a*)) of the looper thread introduction mechanism 110 through the pipe 54, and the jet stream is generated through the ventilation narrow area 114*a* from the gas buffer area 115.

Each looper thread is inhaled from the looper thread inhalation area 114 to the looper thread introduction pipe 116 by sucking with this jet stream, and the gas carrying can be performed to the looper loop-taker point thread outlet 7*b*, 8*b*, 9*b* of the upper looper 7, the lower looper 8 and the looper 9 through the hollow looper thread guide 7*e*, 8*e*, 9*e* of the hollow looper thread guide 130 and the looper thread guide outlet 7*d*, 8*d*, 9*d* of the hollow looper thread guide 7*f*, 8*f*, 9*f* of the threading connecting device 120.

The looper thread guide outlet end 114*b* of the looper thread inhalation area 114 is formed slantingly, thereby the generation of a vortex flow is prevented in the downstream side of the ventilation narrow area 114*a*.

The bottleneck portion 116*c* is formed in the inside of the looper thread introduction pipe 116 which is adjacent to the looper thread inhalation area 114 in the downstream side of the ventilation narrow area 114*a*, and therefore, the gas flow in the ventilation narrow area 114*a* is promoted by reducing the pressure of the downstream side of the bottleneck portion 116*c* and the looper thread is inhaled into the looper thread introduction pipe 116 by generating the negative pressure in the looper thread inhalation area 114.

According to the looper thread introduction mechanism 110 of the gas carrying threading device like this, in the insertion operation of the looper thread to the upper looper 7, the lower looper 8 and the looper 9, when inserting the upper looper thread 16*a*, the lower looper thread 16*b* and the looper thread 16*c* from the thread introducing part, the thread introduction of the upper looper thread 16*a*, the lower looper thread 16*b* and the looper thread 16*c* can be performed strongly and certainly by the looper thread introduction mechanism 110.

Besides, according to the gas carrying threading device of sewing machine of the present invention, the pressurized gas for the gas carrying of the threading of the upper looper thread 16*a*, the lower looper thread 16*b* and the looper thread 16*c* is produced by a gas supply pump 41 which is operated by the sewing machine motor M, and the threading of the upper looper thread 16*a*, the lower looper thread 16*b* and the looper thread 16*c* can be performed by one-touch operation.

Further, according to the gas carrying threading device of sewing machine of the present invention, the threading of the upper looper thread 16*a*, the lower looper thread 16*b* and the looper thread 16*c* can be performed in only one hand by the looper threading/stitch forming changeover mechanism 90.

Therefore, according to the gas carrying threading device of sewing machine of the present invention, by connecting the hollow thread guide 7*e*, 8*e*, 9*e*, 7*f*, 8*f*, 9*f* which leads from the thread outlet 7*b*, 8*b*, 9*b* of the loop-taker point of the upper looper thread 16*a*, the lower looper thread 16*b*, the looper thread 16*c* to the thread introducing part which inserts the thread, the complicated thread guard is unnecessary and the threading that the handleability is easy can be performed. And, there are no mistake of the threading, no protrusion of the thread in mid-process, and no entanglement of the inserted upper looper thread 16*a*, lower looper thread 16*b* and looper thread 16*c* with other thread. And because the thread is fed by utilizing the flow of the pressurized gas which is supplied to the hollow thread guide means, the threading can be performed at once by the extremely easy operation.

Here, in the state that a side surface 170*b* of the tongue piece 170*a* of the prohibition driven arm 170 of the changeover prohibition mechanism 160 is latched together at a side surface portion 168*c* of the prohibition active arm 168, because it is impossible that the clutch changeover pin 65*a*, therefore the clutch changeover arm 65 moves to the stitch forming drive member 64 side even if the changeover is operated to the stitch forming state (counterclockwise direction A) of the looper threading/stitch forming changeover mechanism 90, the abnormal changeover by the special changeover operation to the stitch forming state (counterclockwise direction A) of the looper threading/stitch forming changeover mechanism 90 during the gas supply operation of the gas supply pump is prohibited (FIG. 17 (*a*) shows the operating state after the looper threading/stitch forming changeover manual operating portion (looper threading/stitch forming changeover manual lever) 91 is operated to the counterclockwise direction A).

Next, when performing the stitch formation, if the front cover 161 is closed after the looper threading/stitch forming changeover manual operating portion (looper threading/stitch forming changeover manual lever) 91 of the looper threading/stitch forming changeover mechanism 90 is rotated and returned to the counterclockwise direction A (stitch formation side) (FIG. 10 (*a*), FIG. 13 (*a*), FIG. 17 (*a*)), the front cover opening and closing detection piece 162 is pivoted to the counterclockwise direction by the press of the pressing end 161*a* of the front cover 161 in FIG. 1, FIG. 14, FIG. 15 (*a*), FIG. 17 (*b*), one end 162*b* of the front cover opening and closing detection piece 162 operates the safety switch 163 and the sewing machine motor M becomes ON-state, the pressed protrusion 168*d* of the prohibition active arm 168 is pivoted by a pressing protrusion 162*a* of the front cover opening and closing detection piece 162, and the tip plane portion 168*b* descends. Because the tongue piece 170*a* of the prohibition driven arm 170 is released from the side surface portion 168*c* of the prohibition active arm 168 onto the tip plane portion 168*b*, as described below, the changeover to the stitch forming state (counterclockwise direction A) of the looper threading/stitch forming changeover mechanism 90 is activated, and the stitch forming device 30 can be operated (FIG. 17 (*b*)).

Simultaneously, a rotational angle of the looper threading/stitch forming changeover cam 94 is inhibited by a lever left rotation stopper 94*e*, the clutch changeover transmitter 70 operates adversely for the above, and the looper threading/stitch forming changeover cam 94 rotates around the changeover cam shaft 92 of a rotary axis and draws the clutch changeover link 72 which is attached pivotally at the clutch changeover connecting arm 94*b* (FIG. 10 (*a*)).

The clutch changeover lever 69 which is attached by the clutch changeover lever shaft 68 at a clutch changeover lever attaching hole 71*b* which is provided at a clutch changeover lever supporting arm 71*a* of the clutch changeover lever supporting pedestal 71 is swung to the clockwise direction by a pivot point of the swaging pin 69*a* by drawing the clutch changeover link 72.

The clutch changeover arm 65 which is attached at the clutch changeover arm attaching hole 73*b* which is provided at the clutch changeover arm supporting pedestal 73*a* of the clutch changeover pedestal 73 by the clutch changeover arm shaft 66 and the clutch changeover arm attaching hole 65*b* is swung to the counterclockwise direction through the clutch changeover spring 67. In this case, the clutch changeover pin 65*a* slides in the inside of the through-hole 73*c* which is provided at the clutch changeover arm supporting pedestal 73*a* and positions at a right end (FIG. 9 (*a*)).

As this result, the clutch slider 62 of the clutch 60 slides to the stitch forming drive member 64 side, and the clutch changeover pin 65*a* interrupts the transmission of the power to the pump drive member 61, and the clutch connecting pin 63 is connected to the connecting pin hole 64*a* of the stitch forming drive member 64 with the rotary drive member 23. Therefore, the power to the drive shaft 5 is transmitted, and the stitch forming device 30 can be driven (FIG. 9 (*a*), FIG. 10 (*a*), FIG. 12).

In this case, the clutch 60 holds other clutch stable state by the elasticity of the clutch changeover spring 67. That is, depending on the manual operation of the looper threading/stitch forming changeover manual operating portion (looper threading/stitch forming changeover manual lever) 91, the clutch changeover spring 67 accomplishes the function which moves the clutch slider 62 to the stitch forming drive member 64 which is fastened at one end of the drive shaft 5 and transmits the power to the stitch forming device 30 so that contact/separation becomes free and which holds the contact state.

Therefore, by the timing belt MB from the sewing machine motor M, the drive shaft 5 can be rotated and driven by the drive shaft pulley 21, the drive shaft pulley boss 22 and the stitch forming drive member 64 from the rotary drive member 23 of the clutch 60.

Besides, by rotating the looper threading/stitch forming changeover manual operating portion (looper threading/stitch forming changeover manual lever) 91 of the looper threading/stitch forming changeover mechanism 90 and returning it to the counterclockwise direction A (stitch formation side), because the releasing cam 94*c* (FIG. 11 (*b*)) which is provided at the looper threading/stitch forming changeover cam 94 engages the cam follower 121*g* of the looper thread guide connecting plate 121 and deviates to the opposite direction (right direction in FIG. 5 (A)) of the looper side, the looper threading/stitch forming changeover switch 119*a* is operated at a switch operation part 121*h* of the looper thread guide connecting plate 121, the circuit of the threading button 117 becomes OFF-state, the motor controller (foot controller) MC becomes ON-state, and the sewing machine motor M is rotated and controlled in a variable state through the motor controller (foot controller) MC.

The needle drive mechanism 12 of the stitch forming device 30, the cloth feed mechanism 4 and the looper drive mechanism 10 are driven by the rotation of the drive shaft 5, and the hemstitch seam and (or) the 401 type stitch can be performed on the cloth 25 which is pressed on the throat plate 3 by the presser foot mechanism 19 by the needle 11*a*, 11*b*, 11*c* and the upper looper 7, the lower looper 8, the looper 9 that the looper threading is performed as described above.

Besides, the positioning device 80 operates adversely for the above, and because the press of the follower pin end 84*a* of the follower pin 84 is released by the pin advance/retreat cam 94*d* which is provided at the looper threading/stitch forming changeover cam 94, the positioning pin 82 separates from the notch 81*a* of the positioning plate 81, and because the releasing cam 94*c* (FIG. 11 (*b*)) engages the cam follower 121*g* of the looper thread guide connecting plate 121 and deviates to the opposite direction (right direction in FIG. 5 (A)) of the looper side, the follower pin 84, and the positioning pin 82 which is fitted to this are fitted to the shaft hole 121*a* of the looper thread guide connecting plate 121 from the elongate hole 121*b*. Therefore, in the threading connecting device 120, the looper thread guide outlet 7*d*, 8*d*, 9*d* of the hollow looper thread guide 7*e*, 8*e*, 9*e* and the looper thread inlet 7*a*, 8*a*, 9*a* of the upper looper 7, the lower looper 8 and the looper 9 are separated. Because the looper thread guide outlet 7*d*, 8*d*, 9*d* of the hollow looper thread guide 7*e*, 8*e*, 9*e* and the looper thread inlet 7*a*, 8*a*, 9*a* of the upper looper 7, the lower looper 8 and the looper 9 are separated, the thread take-up lever hole 14*a*, 13*a*, 15*a* of the looper thread take-up lever 14, 13, 15 intervene as the looper thread pass between that, and thereby a looper take-up lever function is performed between the looper thread inlet 7*a*, 8*a*, 9*a* and the thread take-up lever thread guide 133*a*, 139*b*, and the hemstitch seam and (or) the 401 type stitch is performed by the stitch forming device 30 with this looper thread pass separated state.

As described above, in the gas carrying threading device of sewing machine of the present invention, the abnormal changeover by the special changeover operation to the stitch forming state (counterclockwise direction A) of the looper threading/stitch forming changeover mechanism 90 during the gas supply operation of the gas supply pump is prohibited.

As such the prohibition of the abnormal changeover, while pushing the threading button 117 by one hand, when the special operation which rotates and returns the looper threading/stitch forming changeover manual operating portion (looper threading/stitch forming changeover manual lever) 91 to the counterclockwise direction A (stitch formation side) by another hand without releasing the finger from the threading button 117 in the completion of the looper threading is performed, also such the abnormal changeover is prohibited.

Further, the threading button 117 is pushed at the time of the looper threading, and shortly after releasing the finger from the threading button 117 in the completion of the looper threading, instantly, when the special operation which rotates and returns the looper threading/stitch forming changeover manual operating portion (looper threading/stitch forming changeover manual lever) 91 to the counterclockwise direction A (stitch formation side) is performed, also such the abnormal changeover is prohibited.

Temporarily, if these special operations are performed, the sewing machine motor M is driven in the state that the positioning pin 82 of the positioning device 80 is fitted into the notch 81*a* of the positioning plate 81 or the sewing machine motor M keeps being driven by inertia, and the drive shaft 5 is rotated forcibly. As the result, the misalignment of the position of the positioning device 80 occurs, and there is a possibility to cause the phenomenon that the looper thread inlet 7*a*, 8*a*, 9*a* and the thread take-up lever hole which is formed at the looper thread take-up lever do not align horizontally to the looper thread guide outlet. However, because such the abnormal changeover is prohibited, the possibility which causes such the phenomenon disappears completely.

As is clear from the above explanation, according to the gas carrying threading device of sewing machine of the present invention, the pressurized gas for the gas carrying of the looper thread is produced by a gas supply pump which is operated by the sewing machine motor, and the threading to the looper can be performed by one-touch operation by the looper threading/stitch forming changeover manual operating portion (looper threading/stitch forming changeover manual lever).

Further, according to the gas carrying threading device of sewing machine of the present invention, the threading to the looper can be performed in one hand by the looper threading/stitch forming changeover manual operating portion (looper threading/stitch forming changeover manual lever) and the looper threading/stitch forming changeover mechanism.

Therefore, according to the gas carrying threading device of sewing machine of the present invention, by connecting the hollow thread guide which leads from the thread introducing part which inserts the thread to the thread outlet of the loop-taker point of the looper, the complicated thread guard is unnecessary and the threading that the handleability is easy can be performed. And, there are no mistake of the threading, no protrusion of the thread in mid-process, and no entanglement of the inserted looper thread with other thread. And because the thread is fed by utilizing the flow of the pressurized gas which is supplied to the hollow thread guide means, the threading can be performed at once by the extremely easy operation.

Besides, according to the gas carrying threading device of sewing machine of the present invention, by providing the particular changeover prohibition mechanism, the special operation of the changeover to the stitch forming state from the looper threading state is not performed during the gas supply operation of the gas supply pump, and because the abnormal changeover to the stitch forming state of the looper threading/stitch forming changeover mechanism is prohibited, the normal changeover to the stitch forming state from the looper threading state can be performed.

INDUSTRIAL APPLICABILITY

The gas carrying threading device of sewing machine in the present invention can be applied suitably to the chain stitch sewing machine such as the serger, the double chain stitch sewing machine, or the interlock stitch sewing machine for performing the threading automatically to the looper by utilizing the pressurized gas.

EXPLANATION OF THE NUMERALS

M sewing machine motor
2*b* sub-frame
5 drive shaft
6 pulley
7*a*, 8*a*, 9*a* looper thread inlet
7*b*, 8*b*, 9*b* looper loop-taker point thread outlet
7, 8, 9 looper
16*a*, 16*b*, 16*c* looper thread
7*d*, 8*d*, 9*d* looper thread guide outlet
30 stitch forming device
40 gas supply source (41 gas supply pump)
60 clutch
90 looper threading/stitch forming changeover mechanism
91 looper threading/stitch forming changeover manual operating portion (looper threading/stitch forming changeover manual lever)
110 looper thread introduction mechanism
120 threading connecting device
130 hollow looper thread guide (7*e*, 8*e*, 9*e*, 7*f*, 8*f*, 9*f* hollow looper thread guide)
160 changeover prohibition mechanism
161 front cover
161*a* pressing end
162 front cover opening and closing detection piece
164 prohibition active arm attaching pedestal
168 prohibition active arm
168*b* tip plane portion
168*c* side surface portion
169 spring
170 prohibition driven arm
170*a* tongue piece
171 front surface cover
172 axis

The invention claimed is:

1. A gas carrying threading device of sewing machine comprising:

at least one looper having a hollow structure from a looper thread inlet to a looper loop-taker point thread outlet, a looper thread introduction mechanism inserting a looper thread which is led to said looper, a hollow looper thread guide extending from said looper thread introduction mechanism to said looper thread inlet and having a looper thread guide outlet, a gas supply pump that a looper threading of said looper thread is performed from said looper thread introduction mechanism to said looper thread guide outlet through said hollow looper thread guide by the gas carrying, a clutch for respectively transmitting power from the sewing machine motor to a drive shaft driving a stitch forming device including said looper at the time of the stitch formation or to said gas supply pump at the time of the looper threading, a looper threading/stitch forming changeover mechanism for changing over said clutch so that the transmission of the power to said stitch forming device is interrupted and the power is transmitted to said gas supply pump at the time of the looper threading and so that the power is transmitted to said stitch forming device and the transmission of the power to said gas supply pump is interrupted at the time of the stitch formation, a changeover prohibition mechanism for prohibiting an abnormal changeover to a stitch forming state of said looper threading/stitch forming changeover mechanism during a gas supply operation of said gas supply pump; and wherein:

said changeover prohibition mechanism comprises a front cover opening and closing detection piece which is attached pivotally at a sub-frame, detects the opening and closing of the front cover and is attached pivotally at an axis which is formed at a front face cover, a prohibition active arm which is attached pivotally at a prohibition active arm attaching pedestal which is fixed at said sub-frame by resisting elastic repulsion of a spring and is pivoted depending on a pivot of said front cover opening and closing detection piece, and a prohibition driven arm which is fixed at said looper threading/stitch forming changeover mechanism and prohibits an abnormal changeover to a stitch forming state of said looper threading/stitch forming changeover mechanism depending on a pivot of said prohibition active arm during the opening of said front cover, at the time of said looper threading, said front cover is opened, said front cover opening and closing detection piece releases a press of said prohibition active arm by a release of the press of a pressing end which is formed in an inner surface of said front cover, said prohibition active arm is pivoted by the spring, a tongue piece of said prohibition driven arm is latched together at a tip plane portion of said prohibition active arm, the looper threading/stitch forming changeover manual operating portion is changed over to the looper threading state, said stitch forming device is locked by rotating a pulley manually, simultaneously, a threading connecting device is operated, said prohibition driven arm is latched together at a side surface portion from the tip plane portion of said prohibition active arm, and the abnormal changeover to the stitch forming state of said looper threading/stitch forming changeover mechanism is prohibited, at the time of said stitch formation, after said looper threading/stitch forming changeover manual operating portion is changed over to the stitch forming state, said front cover is closed and said front cover opening and closing detection piece which is pivoted by the press of said pressing end which is formed at an inner surface of said front cover is pivoted, said prohibition active arm is pivoted, said prohibition driven arm is released from said side surface portion of said prohibition active arm onto said tip plane portion, the changeover to the stitch forming state of said looper threading/stitch forming changeover mechanism is activated, and said stitch forming device is operated.

2. A gas carrying threading device of sewing machine according to claim 1, wherein:

a looper threading/stitch forming changeover manual operating portion of said looper threading/stitch forming changeover mechanism is hidden by a front cover of the sewing machine which can open and close freely, at the time of the looper threading, said front cover is opened and said looper threading/stitch forming changeover manual operating portion is changed over to the looper threading state, at the time of said stitch formation, after said looper threading/stitch forming changeover manual operating portion is changed over to the stitch forming state, said front cover is closed, thus said stitch forming device is operated.

3. A gas carrying threading device of sewing machine according to claim 1, wherein:

said clutch comprises a pin clutch having a clutch slider which is moved to one of a pump drive member which transmits the power to said gas supply pump and a stitch forming drive member which is fixed to one end of said drive shaft and transmits the power to said stitch forming device so that approach/separation becomes free through a clutch changeover spring depending on a manual operation of a looper threading/stitch forming changeover manual operating portion and that the approach/separation state is held and the power from the sewing machine motor is transmitted.

4. A gas carrying threading device of sewing machine according to claim 1, wherein:

said looper thread guide outlet and said looper thread inlet comprise a threading connecting device which is disposed so that approach/separation becomes free respectively at the time of the looper threading and at the time of the stitch formation depending on the manual operation of the looper threading/stitch forming changeover manual operating portion.

5. A gas carrying threading device of sewing machine according to claim 1, wherein:

by rotating a pulley which is fastened at one end of said drive shaft manually, when said looper thread guide outlet and said looper thread inlet are aligned horizontally, a positioning device which connects said looper thread guide outlet of said hollow looper thread guide and said looper thread inlet of said looper is equipped.

6. A gas carrying threading device of sewing machine according to claim 1, wherein:

in said looper threading/stitch forming changeover mechanism, at the time of the looper threading, the means which changes over said clutch so that the power is transmitted to said gas supply pump and the means which prepares the positioning of the positioning device which connects said looper thread guide outlet of said hollow looper thread guide and said looper thread inlet of said looper, prepares the connection of the threading connecting device which is disposed so that approach/separation becomes free respectively at the time of the looper threading and at the time of the stitch formation, operates said positioning device and interrupts the transmission of the power to said stitch forming device by rotating manually the pulley which is fastened at one end of said drive shaft, and operates said threading connecting device and connects said looper thread guide outlet and said looper thread inlet are included, at the time of the stitch formation, the means which changes over said clutch so that the power is transmitted to said stitch forming device and the means which releases the positioning of said positioning device, and releases the connection of said threading connecting device, and separates said looper thread guide outlet and said looper thread inlet are included.

7. A gas carrying threading device of sewing machine according to claim 5, wherein:

said positioning device has a stop positioning plate, which is coaxially attached at the drive shaft and has a notch at the stop position of the circumferential direction for aligning horizontally the positions of said looper thread guide outlet, a thread take-up lever hole which is formed at a looper take-up lever and said looper thread inlet, and has a positioning pin, which is fitted to said notch by rotating said pulley manually at the time of the looper threading that the looper threading/stitch forming changeover manual operating portion is changed over manually to the looper threading side.

* * * * *